US009261822B2

(12) United States Patent
Matsushita

(10) Patent No.: US 9,261,822 B2
(45) Date of Patent: Feb. 16, 2016

(54) IMAGE FORMING APPARATUS

(71) Applicant: CANON KABUSHIKI KAISHA, Tokyo (JP)

(72) Inventor: Mio Matsushita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,162

(22) Filed: May 21, 2015

(65) Prior Publication Data

US 2015/0362866 A1 Dec. 17, 2015

(30) Foreign Application Priority Data

May 23, 2014 (JP) ..... 2014-107610

(51) Int. Cl.
*G03G 15/00* (2006.01)
*G03G 15/16* (2006.01)
*G03G 21/20* (2006.01)

(52) U.S. Cl.
CPC ..... *G03G 15/161* (2013.01); *G03G 21/203* (2013.01)

(58) Field of Classification Search
CPC ..... G03G 15/161; G03G 15/168; G03G 15/0131; G03G 2215/1661; G03G 21/0011; G03G 21/0035
USPC ..... 399/44, 71, 101
See application file for complete search history.

(56) References Cited

U.S. PATENT DOCUMENTS 6,134,402 A * 10/2000 Nakayama ..... G03G 15/011 399/101
2005/0220478 A1* 10/2005 Ai ..... G03G 15/1605 399/101
2011/0158677 A1* 6/2011 Kikuchi ..... G03G 15/161 399/101

FOREIGN PATENT DOCUMENTS

JP 2-123385 A 5/1990
JP 2006-267682 A 10/2006

* cited by examiner

*Primary Examiner* — Walter L Lindsay, Jr.
*Assistant Examiner* — Jessica L Eley
(74) *Attorney, Agent, or Firm* — Canon USA Inc. IP Division

(57) ABSTRACT

An image forming apparatus includes a control unit configured to control a cleaning operation of rotating an intermediate transfer member to remove an adjustment toner image, which is formed on an image bearing member and attached to the intermediate transfer member during an adjustment operation, at a cleaning portion where toner is electrostatically removed. The control unit is configured to change the number of times of rotating the intermediate transfer member to convey the adjustment toner image on the intermediate transfer member to the cleaning portion according to at least one of a density and a length in a conveyance direction of the intermediate transfer member regarding the adjustment toner image on the intermediate transfer member before being conveyed to the cleaning portion.

10 Claims, 16 Drawing Sheets

IMAGE FORMING APPARATUS

BACKGROUND OF THE INVENTION

1. Field of the Invention

The present invention relates to an image forming apparatus such as a copy machine, a printer, and a facsimile apparatus using an electrophotographic method, an electrostatic recording method, or the like.

2. Description of the Related Art

Conventionally, as an image forming apparatus using the electrophotographic method or the like, there has been a tandem-type image forming apparatus including a plurality of image forming units disposed along a rotational path of an intermediate transfer member to form a full color image.

Then, for the image forming apparatus using the intermediate transfer member, there is a technique for correcting a density by forming an adjustment toner image (hereinafter also referred to as a "patch") at a predetermined density on the intermediate transfer member, detecting the density of the patch, and then providing a feedback according to the detected density of the patch to reflect it in an image forming condition.

Further, for the image forming apparatus using the intermediate transfer member, there is a method for cleaning the intermediate transfer member by electrostatically attracting toner to a cleaning member to remove the toner from the intermediate transfer member, which is called an electrostatic cleaning method.

However, generally, a cleaning device based on the electrostatic cleaning method is configured to remove a small amount of toner (transfer residual toner or remaining toner) remaining on the intermediate transfer member after a secondary transfer of a toner image from the intermediate transfer member onto a transfer medium. Therefore, in some cases, it may be difficult to completely remove the patch generated using a large amount of toner compared to the transfer residual toner by performing the cleaning only once.

To solve this problem, Japanese Patent Application Laid-Open No. 2006-267682 discusses a technique for detecting residual toner left without being cleaned on an intermediate transfer member, and optimizing a voltage to be applied to a cleaning member or inserting a forcible cleaning mode to forcibly clean the intermediate transfer member until the residual toner is eliminated.

However, according to the technique for detecting the residual toner on the intermediate transfer member and forcibly cleaning the intermediate transfer member until the residual toner is eliminated, the residual toner should be detected after the residual toner on the intermediate transfer member passes through a cleaning portion. Therefore, the productivity is reduced according to a time taken until the residual toner passes through the cleaning portion. Further, a cleaning setting is changed after the residual toner is detected, whereby a cleaning failure occurs in an image (a printed matter) formed during this period.

SUMMARY OF THE INVENTION

According to an aspect of the present invention, an image forming apparatus includes an image bearing member configured to bear a toner image, a movable intermediate transfer member configured to temporarily bear the toner image that is transferred from the image bearing member at a first transfer portion and then transferred onto a recording medium at a second transfer portion, a cleaning member disposed opposing the intermediate transfer member on a downstream side of the second transfer portion and on an upstream side of the first transfer portion in a movement direction of the intermediate transfer member, and configured to electrostatically remove toner on the intermediate transfer member at a cleaning portion, a forming portion configured to form, on the intermediate transfer member, an adjustment toner image having a predetermined target density and a predetermined length in the movement direction of the intermediate transfer member, a detection portion configured to detect the adjustment toner image formed on the intermediate transfer member, a change portion configured to change an image forming condition according to a detection result of the detection portion, and an execution portion configured to move the intermediate transfer member to cause a region on the intermediate transfer member that corresponds to a position at which the adjustment toner image is formed to pass through the cleaning portion, wherein the execution portion sets the number of times of repeatedly causing the region to pass through the cleaning portion based on at least one of the target density and the length of the adjustment toner image.

According to another aspect of the present invention, an image forming apparatus includes a first image bearing member and a second image bearing member configured to bear toner images thereon, respectively, the intermediate transfer member configured to be movable and temporarily bear the toner images that are transferred from the first and second image bearing members at respective first transfer portions and then transferred onto a recording medium at a second transfer portion, the first image bearing member and the second image bearing member being arranged side by side in a movement direction of the intermediate transfer member, a forming portion configured to form a first adjustment toner image and a second adjustment toner image, the first adjustment toner image being detected on the intermediate transfer member after being formed on the first image bearing member and then transferred onto the intermediate transfer member by applying a transfer electric field at the first transfer portion of the first image bearing member, the second adjustment toner image being formed on the second image bearing member and then detected on the second image bearing member, the second adjustment toner image being partially attached to the intermediate transfer member without the transfer electric field applied at the first transfer portion of the second image bearing member, a cleaning member disposed opposing the intermediate transfer member on a downstream side of the second transfer portion and on an upstream side of the first transfer portion in the movement direction of the intermediate transfer member, and configured to electrostatically remove toner on the intermediate transfer member at a cleaning portion, a first detection portion configured to detect the first adjustment toner image on the intermediate transfer member, a second detection portion configured to detect the second adjustment toner image on the second image bearing member, a change portion configured to change an image forming condition according to a detection result of at least one of the first detection portion and the second detection portion, and an execution portion configured to move the intermediate transfer member to cause regions on the intermediate transfer member that correspond to positions at which the first and second adjustment toner images are formed to pass through the cleaning portion, wherein the execution portion sets the number of times of repeatedly causing each of the regions to pass through the cleaning portion to a different number between a removal of the first adjustment toner image and a removal of the second adjustment toner image.

Further features of the present invention will become apparent from the following description of exemplary embodiments with reference to the attached drawings.

DESCRIPTION OF THE EMBODIMENTS

In the following description, an image forming apparatus according to an exemplary embodiment of the present invention will be described in further detail with reference to the drawings.

1. Overall Configuration and Operation of Image Forming Apparatus

Figure 1:
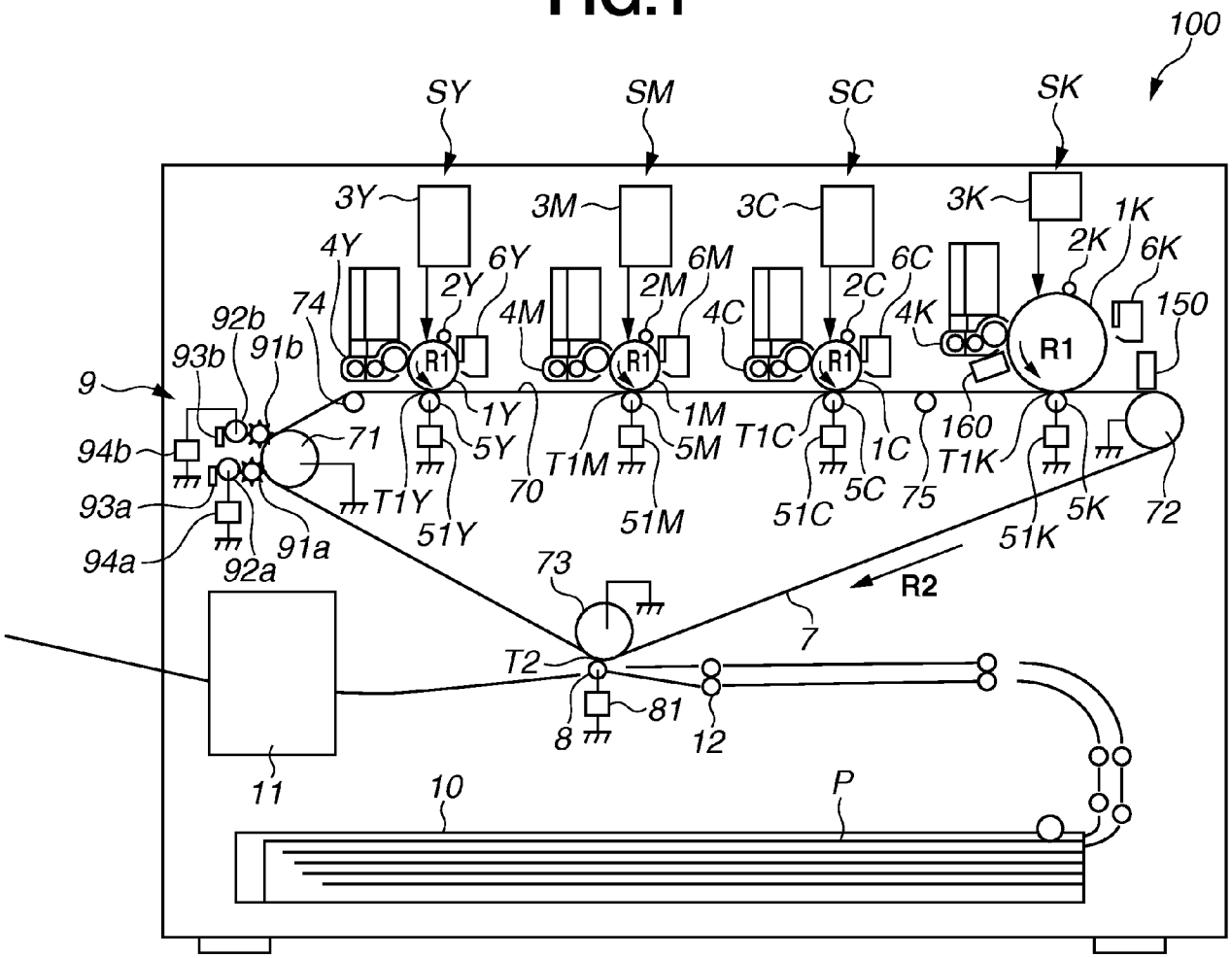
FIG. 1 is a cross-sectional view illustrating an overview of an image forming apparatus (in a full color mode).

FIG. 1 is a cross-sectional view illustrating an overview of an image forming apparatus according to a first exemplary embodiment of the present invention. The image forming apparatus 100 according to the present exemplary embodiment is a tandem-type laser beam printer employing the intermediate transfer method, which can form a full color image on a transfer medium (recording paper, an overhead projector (OHP) sheet, a fabric, or the like) with use of the electrophotographic method.

The image forming apparatus 100 includes first, second, third, and fourth image forming units SY, SM, SC, and SK as a plurality of image forming units (stations). Theses image forming units SY, SM, SC, and SK form yellow (Y), magenta (M), cyan (C), and black (K) images, respectively. In the present exemplary embodiment, the respective image forming units SY, SM, SC, and SK have a lot in common in terms of configurations and operations thereof except for a difference in color of toner used therein. Therefore, hereinafter, elements in the first to fourth image forming units SY, SM, SC, and SK will be described collectively, omitting alphabets Y, M, C, and K that are added at the ends of reference numerals for indicating which color that element is provided for, unless there is a necessity for distinguishing them especially.

The image forming unit S includes a photosensitive drum 1, which is a drum-shaped (cylindrical) electrophotographic photosensitive member (photosensitive member) as a rotatably disposed image bearing member. The photosensitive drum 1 is rotationally driven in a direction indicated by an arrow R1 in FIG. 1 by a driving motor (not illustrated) as a driving unit. The following process devices are disposed around the photosensitive drum 1. First, a charging roller 2 as a charging unit is disposed. Next, an exposure device 3 as an exposure unit is disposed. Next, a development device 4 as a development unit is disposed. Next, a drum cleaning device 6 as a photosensitive member cleaning unit is disposed. Yellow toner, magenta toner, cyan toner, and black toner are contained in the development devices 4Y, 4M, 4C, and 4K of the image forming units SY, SM, SC, and SK, respectively. Further, in the present exemplary embodiment, the photosensitive drum 1K has a larger diameter at the fourth image forming unit SK than diameters at the other image forming units SY, SM, and SC, and the fourth image forming unit SK includes a sensor for detecting a density of a patch that will be described below.

An intermediate transfer belt 7 made of an endless belt as an intermediate transfer member is disposed opposing the respective photosensitive drums 1 of the image forming units S. The intermediate transfer belt 7 is held by a driving roller 71, a tension roller 72, a secondary transfer counter roller 73, and push-up rollers 74 and 75 as support members (stretching rollers). The driving roller 71 transmits driving to the intermediate transfer belt 7. The tension roller 72 applies a predetermined tensile force to the intermediate transfer belt 7. The secondary transfer counter roller 73 serves as a counter member (an opposing electrode) for a secondary transfer roller 8, which will be described below. The push-up rollers 74 and 75 form a primary transfer plane 70 for transferring a toner image onto the intermediate transfer belt 7. The four image forming units SY, SM, SC, and SK are arranged in series along a horizontal portion of this primary transfer plane 70. The driving roller 71 is rotationally driven by a driving motor (not illustrated) as a driving unit, such as a pulse motor, at a circumferential speed of 350 mm/sec. By this rotation, the intermediate transfer belt 7 is rotated (circulated) in a direction indicated by an arrow R2 in FIG. 1 (hereinafter also referred to as a "rotational direction" or a "conveyance direction"). The stretching rollers other than the driving roller 71 are rotated by being driven by the rotation of the intermediate transfer belt 7.

A primary transfer roller 5, which is a roller-shaped primary transfer member as a primary transfer unit, is disposed on an inner circumferential surface (back surface) side of the intermediate transfer belt 7 at a position opposing each of the photosensitive drums 1 of the image forming units S. The primary transfer roller 5 is urged (pressed) toward the photosensitive drum 1 via the intermediate transfer belt 7 to form a primary transfer portion (a primary transfer nip) T1 where the intermediate transfer belt 7 and the photosensitive drum 1 are in contact with each other. Further, the secondary transfer roller 8, which is a roller-shaped secondary transfer member as a secondary transfer unit, is disposed on an outer circumferential surface (front surface) side of the intermediate transfer belt 7 at a position opposing the secondary transfer counter roller 73. The secondary transfer roller 8 is urged (pressed) toward the secondary transfer counter roller 73 via the intermediate transfer belt 7 to form a secondary transfer portion (a secondary transfer nip) T2 where the intermediate transfer belt 7 and the secondary transfer roller 8 are in contact with each other. Further, a belt cleaning device 9 as an intermediate transfer member cleaning unit is disposed on the outer circumferential surface side of the intermediate transfer belt 7 at a position opposing the driving roller 71.

The rotating photosensitive drum 1 is evenly charged by the charging roller 2. The charged photosensitive drum 1 is exposed to light by the exposure device 3 according to image information, and an electrostatic latent image (an electrostatic image) according to the image information is formed on the photosensitive drum 1. The toner of the color corresponding to each of the image forming units S is supplied from the development device 4, by which the electrostatic latent image formed on the photosensitive drum 1 is developed as a toner image. The toner image formed on the photosensitive drum 1 is transferred onto the rotating intermediate transfer belt 7 at the primary transfer portion T1 with the operation of the primary transfer roller 5 (a primary transfer). At this time, a primary transfer bias (a primary transfer voltage), which is a direct-current voltage having an opposite polarity of a charged polarity (a normal charged polarity) of the toner at the time of the development, is applied from a primary transfer power source 51 as a bias application unit to the primary transfer roller 5, by which a primary transfer electric field is generated at the primary transfer portion T1. In the present exemplary embodiment, the primary transfer power sources 51Y, 51M, 51C, and 51K are connected to the primary transfer rollers 5Y, 5M, 5C, and 5K of the image forming units SY, SM, SC, and SK, respectively. For example, when a full color image is formed, the toner images of the respective yellow, magenta, cyan, and black colors formed at the image forming units S are sequentially transferred onto the intermediate transfer belt 7 at the respective primary transfer portions T1 in such a manner that they are superimposed one after another on the intermediate transfer belt 7.

The toner images transferred onto the intermediate transfer belt 7 are transferred onto a transfer medium P at the secondary transfer portion T2 with the operation of the secondary transfer roller 8 (a secondary transfer). At this time, a secondary transfer bias (a secondary transfer voltage), which is a direct-current voltage having the opposite polarity of the normal charged polarity of the toner, is applied from a secondary transfer power source 81 as a bias application unit to the secondary transfer roller 8, by which a secondary transfer electric field is generated at the secondary transfer portion T2. Further, by this time, the transfer medium P is supplied from a sheet feed cassette 10, and is conveyed to the secondary transfer portion T2 at a predetermined timing after being temporarily stopped at a registration roller 12. The transfer medium P with the toner images transferred thereon is conveyed to a fixing device 11. At the fixing device 11, the toner images are fixed (fixedly attached) onto the transfer medium P by heat and a pressure. After that, the transfer medium P is discharged (output) to the outside of an apparatus main body of the image forming apparatus 100.

Transfer residual toner on the photosensitive drum 1 that is left to be transferred onto the intermediate transfer belt 7 during the primary transfer process is removed and collected from the photosensitive drum 1 by the drum cleaning device 6. Further, transfer residual toner on the intermediate transfer belt 7 that is left to be transferred onto the transfer medium P during the secondary transfer process is removed and collected from the intermediate transfer belt 7 by the belt cleaning device 9.

2. Configuration of Each Unit 2-1. Photosensitive Drum

The photosensitive drum 1 is formed by coating an organic photo conductor layer (OPC) on an outer circumferential surface of an aluminum cylinder. The photosensitive drum 1 is rotatably supported at both ends in a longitudinal direction thereof (a direction along a rotational axis) by flanges, and is rotationally driven by transmission of a driving force from the driving motor (not illustrated) to one of the ends. In the present exemplary embodiment, a charged polarity of the photosensitive drum 1 is a negative polarity.

In the present exemplary embodiment, the photosensitive drums 1Y, 1M, and 1C of the first, second, and third image forming units SY, SM, and SC, which are the image forming units for the respective yellow, magenta, and cyan colors, each have an outer diameter of ϕ30 (mm). On the other hand, the photosensitive drum 1K of the fourth image forming unit SK, which is the image forming unit for the black color, has an outer diameter of ϕ80 (mm). In other words, only the photosensitive drum 1K for the black color is larger in diameter than the photosensitive drums 1Y, 1M, and 1C for the other colors.

2-2. Charging Roller

The charging roller 2 is a contact charging member that evenly charges a circumferential surface of the photosensitive drum 1 by contacting the surface of the photosensitive drum 1. The charging roller 2 is a conductive roller including an elastic layer formed around a core metal (a core member). The charging roller 2 is rotatably held by bearing members, and is also urged toward the photosensitive drum 1 by pressing springs as urging units at both ends in a longitudinal direction thereof (a direction along a rotational axis). With this configuration, the charging roller 2 is placed into pressure contact with the surface of the photosensitive drum 1 with a predetermined pressing force, and is rotated by being driven by the rotation of the photosensitive drum 1. A charging bias (a charging voltage) controlled under a predetermined condition is applied from a charging power source 21 (refer to FIG. 4) as a bias application unit to the core metal of the charging roller 2. With this configuration, the circumferential surface of the rotating photosensitive drum 1 is charged so as to have a predetermined potential of a predetermined polarity (the negative polarity in the present exemplary embodiment). In the present exemplary embodiment, the charging bias is an oscillating voltage generated by superimposing a direct-current voltage (Vdc) and an alternating-current voltage (Vac). More specifically, the charging bias is an oscillating voltage generated by superimposing a direct-current voltage (a direct-current component) of −600 V, and a sinusoidal alternating-current voltage (an alternating-current component) having a frequency f of 1 kHz and a peak-to-peak voltage Vpp of 1.5 kV. By this charging bias, the circumferential surface of the photosensitive drum 1 is evenly charged to −600 V (a dark potential Vd).

2-3. Exposure Device

The exposure device 3 is a laser scanner device that includes a laser light source, a polygonal mirror, and the like, and is controlled to be lighted by a driving circuit according to an image signal. The exposure device 3 emits a laser beam according to an image signal for a component color on a document that corresponds to each of the image forming units S onto the photosensitive drum 1 via the polygonal mirror and the like.

2-4. Development Device

The development device 4 uses a two-component developer including non-magnetic toner and magnetic carrier as a developer. In the present exemplary embodiment, the toner is toner having a negatively charged characteristic. The development device 4 includes a development container containing the developer. Further, the development device includes a development sleeve as a developer bearing member disposed so as to be partially exposed from an opening portion of the developer container that is located opposing the photosensitive drum 1. The development sleeve is disposed adjacent to the surface of the photosensitive drum 1 and is rotationally driven by a driving motor (not illustrated) as a driving unit, and a predetermined development bias (a development voltage) is applied from a development power source (not illustrated) as a bias application unit to the development sleeve. With this configuration, the toner is supplied from the developer borne by the development sleeve and conveyed to a position opposing the photosensitive drum 1 (a development portion), and the electrostatic latent image on the photosensitive drum 1 is developed as the toner image. In the present exemplary embodiment, the development device 4 forms the toner image by a reversal development in which the toner having the same polarity as the charged polarity of the photosensitive drum 1 is attached onto an exposed portion on the photosensitive drum 1 that is exposed to reduce an absolute value of the potential thereon after being evenly charged. An external additive for increasing releasability of the toner is added to the toner.

2-5. Primary Transfer Roller

The primary transfer roller 5 is a conductive roller including an elastic layer formed around a core metal (a core member). The core metal is a cylindrical-shaped member made from conductive metal and having a diameter of 8 mm. The elastic layer is a conductive foam material having a resistance value of $1.0\times10^4$ to $5.0\times10^6$[Ω] and a thickness of 0.5 mm, and is formed around the core metal to cover the core metal. Further, a weight of the primary transfer roller 5 is 300 g. In the present exemplary embodiment, the primary transfer rollers 5 have equal outer diameters in all of the image forming units S.

The primary transfer roller 5 is supported by a pressing mechanism so as to be brought into contact with the photosensitive drum 1 from the back surface of the intermediate transfer belt 7 to allow the toner image to be transferred from the photosensitive drum 1 onto the intermediate transfer belt 7 by an electric action and a pressing force. In the present exemplary embodiment, the primary transfer roller 5 is vertically upwardly pressed at both ends in a longitudinal direction thereof (a direction along a rotational axis) by pressing springs as urging units.

Figure 15:
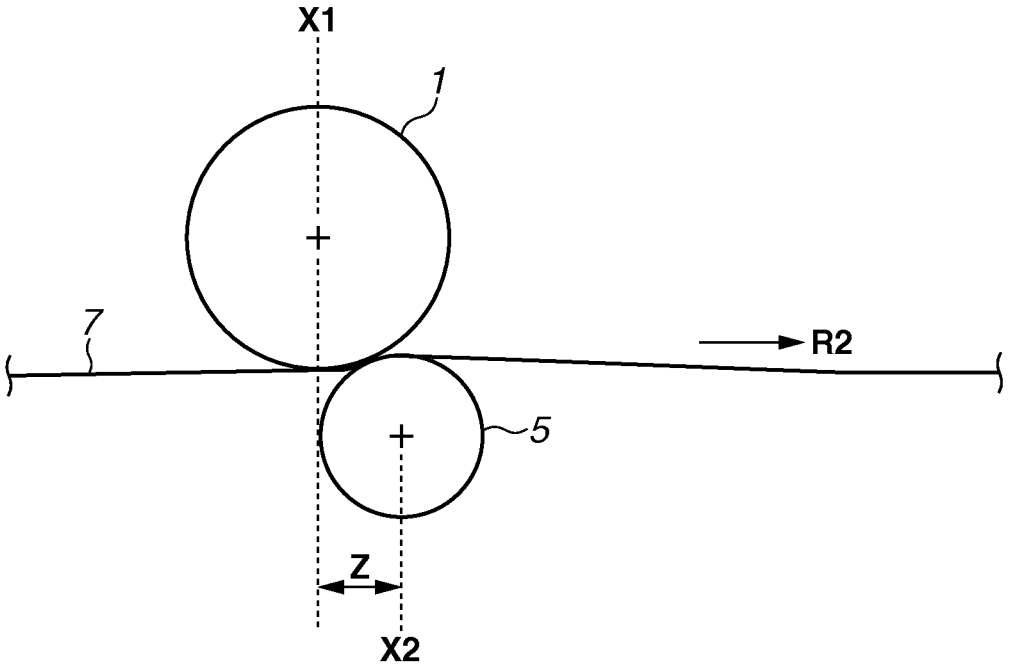
FIG. 15 is a schematic diagram illustrating a shift amount of a primary transfer roller.

The primary transfer roller 5 is shifted toward a downstream side in the conveyance direction of the intermediate transfer belt 7 with respect to a vertical direction passing through a rotational center of the photosensitive drum 1. In the present exemplary embodiment, the primary transfer rollers 5Y, 5M, and 5C of the first, second, and third image forming units SY, SM, and SC each are shifted by a shift amount of 2.5 mm, and the primary transfer roller 5K of the fourth image forming unit SK is shifted by a shift amount of 4.5 mm. As illustrated in FIG. 15, assume that X1 represents a straight line passing through the rotational center of the photosensitive drum 1 and perpendicularly intersecting the intermediate transfer belt 7 from the photosensitive drum 1 on an upstream side in the conveyance direction of the intermediate transfer belt 7. Further, assume that X2 represents a straight line passing through a rotational center of the primary transfer roller 5 and extending in parallel with the straight line X1. In this case, in the present exemplary embodiment, a shift amount Z of the primary transfer roller 5 from the photosensitive drum 1 can be represented by a shift amount of the straight line X2 from the straight line X1.

The pressing force of the primary transfer roller 5 can be measured with use of a pressure measurement tool. For example, the pressing force of the primary transfer roller 5 is measured by preparing a pseudo metallic counter roller having an equal diameter to the photosensitive drum 1 and divided into five pieces in the direction along the rotational axis, and detecting a pressure applied to the metallic counter roller with use of a load cell. This measurement system can be set inside the apparatus main body of the image forming apparatus 100, and can measure the pressure actually applied form the primary transfer roller 5 to the photosensitive drum 1. Further, this measurement system can measure a pressure distribution in the longitudinal direction of the primary transfer roller 5 because the metallic counter roller divided into the five pieces is used. In the present exemplary embodiment, the pressing force of each of the primary transfer rollers 5Y, 5M, and 5C in the first, second, and third image forming units SY, SM, and SC is 600 gf to 800 gf in total. On the other hand, the pressing force of the primary transfer roller 5K in the fourth image forming unit SK is 1300 gf to 1500 gf in total. Excellent transferability can be acquired by setting the shift amount and the pressure according to the diameter of the photosensitive drum 1 that the primary transfer roller 5 presses.

In the present exemplary embodiment, the primary transfer portions T1 of the image forming units S adjacent to each other in the conveyance direction of the intermediate transfer belt 7 are spaced apart from each other by a distance of 120 mm.

In the present exemplary embodiment, the image forming apparatus 100 can carry out a full color mode (a first image forming mode) and a black monochrome mode (a second image forming mode or a monochrome image forming mode) as a plurality of image forming modes, each of which uses a different number of image forming units S to form a toner image. In the full color mode, the first, second, third, and fourth image forming units SY, SM, SC, and SK each form a corresponding color toner image, by which the image forming apparatus 100 can form a full color image. In the black monochrome mode, only the fourth image forming unit SK forms a toner image as a predetermined image forming unit among the first, second, third, and fourth image forming units SY, SM, SC, and SK, by which the image forming apparatus 100 can form an image of the black color. The image forming apparatus 100 includes a belt contact/separation mechanism 170 (refer to FIG. 4), which allows the unused photosensitive drums 1Y, 1M, and 1C of the image forming units SY, SM, and SC and the intermediate transfer belt 7 to be separated from each other in the black monochrome mode.

Figure 2:
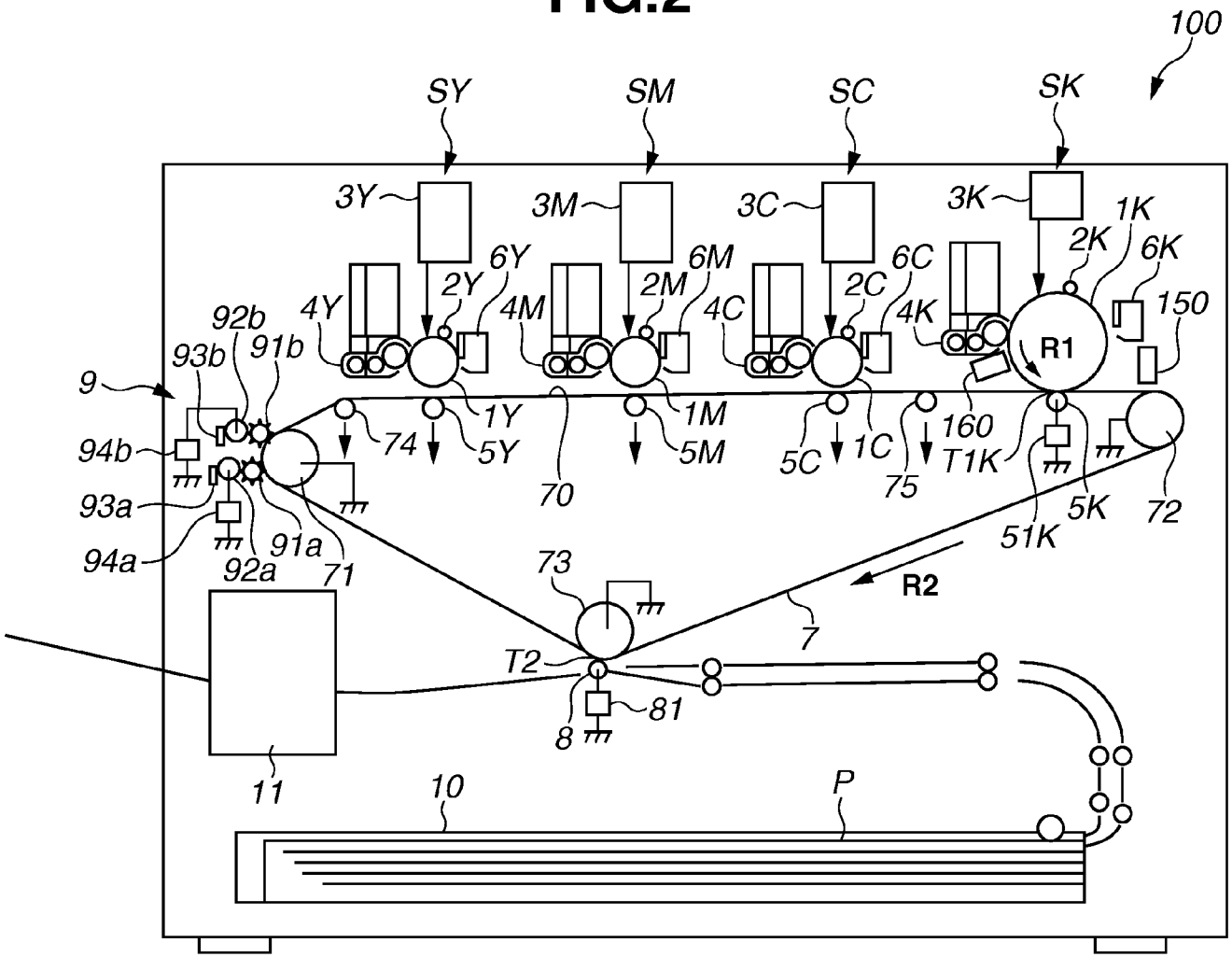
FIG. 2 is a cross-sectional view illustrating an overview of the image forming apparatus (in a black monochrome mode).

In the present exemplary embodiment, the primary transfer plane 70 is displaced by vertical movements of the push-up rollers 74 and 75 and the primary transfer rollers 5Y, 5M, and 5C of the first, second, and third image forming units SY, SM, and SC, as illustrated in FIG. 2. In the full color mode, the primary transfer plane 70 is formed by the push-up rollers 74 and 75 and the tension roller 72. In the black monochrome mode, the primary transfer plane 70 is formed by the push-up roller 75 and the tension roller 72 located downstream in the conveyance direction of the intermediate transfer belt 7. With this configuration, in the full color mode, the photosensitive drums 1Y, 1M, 1C, and 1K of the first, second, third, and fourth image forming units SY, SM, SC, and SK, and the intermediate transfer belt 7 are brought into contact with each other. On the other hand, in the black monochrome mode, the photosensitive drums 1Y, 1M, and 1C of the first, second, and third image forming units SY, SM, and SC, and the intermediate transfer belt 7 are separated from each other. In this manner, the image forming apparatus 100 is configured to be able to selectively switch the black monochrome mode and the full color mode. The belt contact/separation mechanism 170 includes a support member or support members of the push-up rollers 74 and 75 and the primary transfer rollers 5Y, 5M and 5C of the first, second, and third image forming units SY, SM, and SC, a switching unit or switching units for moving these rollers via the support member(s), and the like. In the present exemplary embodiment, a solenoid is used as this switching unit. The switching unit(s) selectively move(s) the above-described respective rollers vertically, i.e., between first position where each of the rollers causes the intermediate transfer belt 7 to be displaced further closer to the photosensitive drum 1, and second position where each of the rollers causes the intermediate transfer belt 7 to be further separated from the photosensitive drum 1. In the present exemplary embodiment, the image forming apparatus 100 is configured to be able to separate the unused photosensitive drums 1Y, 1M, and 1C of the first, second, and third image forming units SY, SM, and SC from the intermediate transfer belt 7 in the black monochrome mode, thereby attempting to extend operating lives of these photosensitive drums 1Y, 1M, and 1C. Further, the image forming apparatus 100 includes the photosensitive drum 1K large in diameter in the fourth image forming unit SK for the black color, which is generally highly frequently used in most cases, thereby attempting to extend an operating live of this photosensitive drum 1K. The image forming unit S using the photosensitive drum 1 large in diameter does not necessarily have to be the image forming unit SK for the black color, and does not necessarily have to be the image forming unit S located most downstream in the conveyance direction of the intermediate transfer belt 7. Further, the image forming unit S using the photosensitive drum 1 large in diameter does not necessarily have to be only a single image forming unit S, such as the image forming unit SK for the black color. A plurality of image forming units S may use the photosensitive drums 1 having larger outer diameters than the other image forming units S (the outer diameters of the photosensitive drums 1 may be equal or different among this plurality of image forming units S). Further, the photosensitive drums 1 may have equal outer diameters among all of the image forming units S if desired.

In the present exemplary embodiment, the primary transfer bias is determined by known Active Transfer Voltage Control (ATVC) (refer to Japanese Patent Application Laid-Open No. 2-123385). More specifically, a desired constant-current voltage is applied to the primary transfer roller 5 when the image forming apparatus 100 does not form an image, and a voltage value at this time is held. Then, a constant voltage according to this voltage value is applied to the primary transfer roller 5 as the primary transfer voltage at the time of the primary transfer when the image forming apparatus 100 forms an image. An optimum current is found out in advance as a primary transfer current at the time of the application of the constant-current voltage when the image forming apparatus 100 does not form an image, and a transfer electric field at the primary transfer portion T1 when this current is set as a target current is determined.

2-6. Intermediate Transfer Belt

Figure 16:
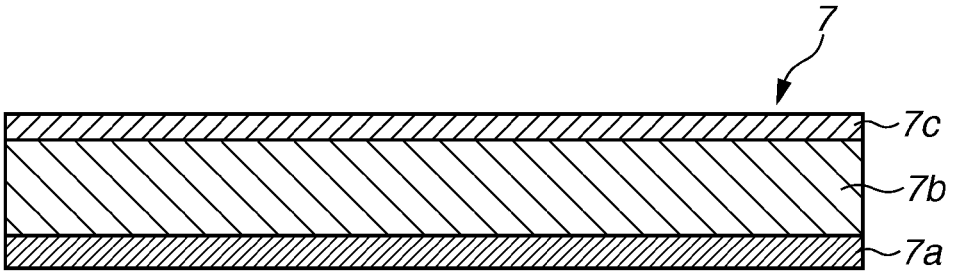
FIG. 16 is a schematic cross-sectional view illustrating a structure of layers of an intermediate transfer belt.

In the present exemplary embodiment, a belt including a plurality of layers and including an elastic layer (hereinafter also referred to as an "elastic intermediate transfer belt") is used as the intermediate transfer belt 7. FIG. 16 is a schematic cross-sectional view illustrating an example layer structure of the elastic intermediate transfer belt 7. In the present exemplary embodiment, the elastic intermediate transfer belt 7 has a three-layered structure including a base layer (a resin layer) 7*a*, an elastic layer 7*b*, and a front layer 7*c*. The elastic intermediate transfer belt 7 according to the present exemplary embodiment has a surface resistivity of $10^{12}\Omega/\square$ and a volume resistivity of $10^{12}$ Ω·cm in the three layers to maintain imageability. The resistivity was measured with use of Hiresta UP MCP-HT450 with a UR probe, which was a high resistivity meter available from Mitsubishi Chemical Analytech, Co., Ltd., under an applied voltage of 1000 V and an applied time period of 10 seconds as measurement conditions. Further, desirable film thicknesses of the respective layers of the elastic intermediate transfer belt 7 are approximately 50 to 100 μm for the base layer 7*a*, approximately 200 to 300 μm for the elastic layer 7*b*, and approximately 2 to 20 μm for the front layer 7*c*. In the present exemplary embodiment, the base layer 7*a*, the elastic layer 7*b*, and the front layer 7*c* have film thicknesses of 85 μm, 260 μm, and 2 μm, respectively. Further, a desirable surface hardness of the elastic intermediate transfer belt 7 in the three layers is approximately 40 to 90 degrees in the International Rubber Hardness Degrees (IRHD) scale. In the present exemplary embodiment, the surface hardness of the elastic intermediate transfer belt 7 is 73±3 degrees.

The base layer 7*a* and the elastic layer 7*b* may be made of any materials that can meet the above-described characteristics. Representative examples thereof are as follows. The base layer (the resin layer) 7*a* can be made of a resin material such as polycarbonate, a fluorine-based resin (ethylene-tetrafluoroethylene (ETFE) or polyvinylidene difluoride (PVDF)), a polyamide resin, and a polyimide resin that have a Young's modulus of $5.0\times10^2$ to $5.0\times10^3$ MPa (compliant with Japanese Industrial Standards (JIS) K7127). Further, the elastic layer 7*b* can be made of an elastic material (an elastic material rubber or an elastomer) such as a butyl rubber, a fluorine-based rubber, a chloroprene (CR) rubber, ethylene propylene diene monomer (EPDM), and a urethane rubber that have a Young's modulus of 0.1 to $1.0\times10^2$ MPa. Further, the material of the front layer 7*c* is not especially limited, but is desirably a material that can reduce a force of attaching the toner onto the surface of the intermediate transfer belt 7 to improve secondary transferability. Examples thereof include a resin material such as a fluorine-based resin and a fluorine compound, a urethane-based resin with fluorine-based resin particles distributed therein, and an elastic material that have a Young's modulus of $1.0\times10^2$ to $5.0\times10^3$ MPa. However, none of the base layer 7*a*, the elastic layer 7*b*, and the front layer 7*c* is limited to the above-described materials. In this manner, in the present exemplary embodiment, the intermediate transfer member includes at least a plurality of layers, and the layer on the surface side that bears the toner image has a lower hardness than the lowermost layer on the surface side that does not bear the toner image.

In the present exemplary embodiment, the above-described elastic intermediate transfer belt is used as the intermediate transfer belt 7. However, a single-layered belt such as a resin belt may be used as the intermediate transfer belt 7.

In the present exemplary embodiment, the photosensitive drum 1 and the intermediate transfer belt 7 are driven in such a manner that a difference between the speed of the surface of the photosensitive drum 1 and the speed of the surface of the intermediate transfer belt 7 falls within a range of 1 to 5%.

2-7. Secondary Transfer Roller

The secondary transfer roller 8 is a conductive roller including an elastic layer made of an ion conductive foamed rubber (a nitrile butadiene rubber (NBR)) that is formed around a core metal (a core member). This secondary transfer roller 8 has an outer diameter of 24 mm and a roller surface roughness of Rz=6.0 to 12.0 (μm). Further, this secondary transfer roller 8 has a resistance value of $1.0\times10^5$ to $1.0\times10^8\Omega$ measured under a normal temperature and normal humidity (N/N) environment (a temperature of 23° C. and a relative humidity (RH) of 50%) and an applied voltage of 2 kV.

In the present exemplary embodiment, the image forming apparatus 100 includes a secondary transfer roller contact/separation mechanism 180 (refer to FIG. 4), which brings the secondary transfer roller 8 into contact with the intermediate transfer belt 7, and separates the secondary transfer roller 8 from the intermediate transfer belt 7. With this mechanism, the secondary transfer roller is configured to be able to be selectively switched between an operable state in which the secondary transfer roller 8 is in contact with the intermediate transfer belt to be rotated according to the rotation of the intermediate transfer belt 7, and an inoperable state in which the secondary transfer roller 8 is separated from the intermediate transfer belt 7. The secondary transfer roller contact/separation mechanism 180 includes a support member of the secondary transfer roller 8, a switching unit for moving the secondary transfer roller 8 via this support member, and the like. In the present exemplary embodiment, a solenoid is used as this switching unit. The switching unit selectively moves the secondary transfer roller 8 vertically, i.e., between a first position where the secondary transfer roller 8 is brought into contact with the intermediate transfer belt 7, and a second position where the secondary transfer roller 8 is separated from the intermediate transfer belt 7. In the present exemplary embodiment, the secondary transfer roller 8 is separated from the intermediate transfer belt 7 when the patch passes through the secondary transfer portion T2, as will be described below. Further, in the present exemplary embodiment, the secondary transfer roller 8 is configured to be separated from the intermediate transfer belt 7 immediately, when the secondary transfer roller 8 is maintained in contact with the intermediate transfer belt 7 for two seconds or longer, for example, during a time interval between sheets other than a time period during which the transfer medium P passes through the secondary transfer portion T2 (a sheet passing time period). With this configuration, a back side of the transfer medium P can be prevented from being contaminated by the toner attached to the secondary transfer roller 8.

2-8. Belt Cleaning Device (Electrostatic Fur Cleaning)

Figure 3:
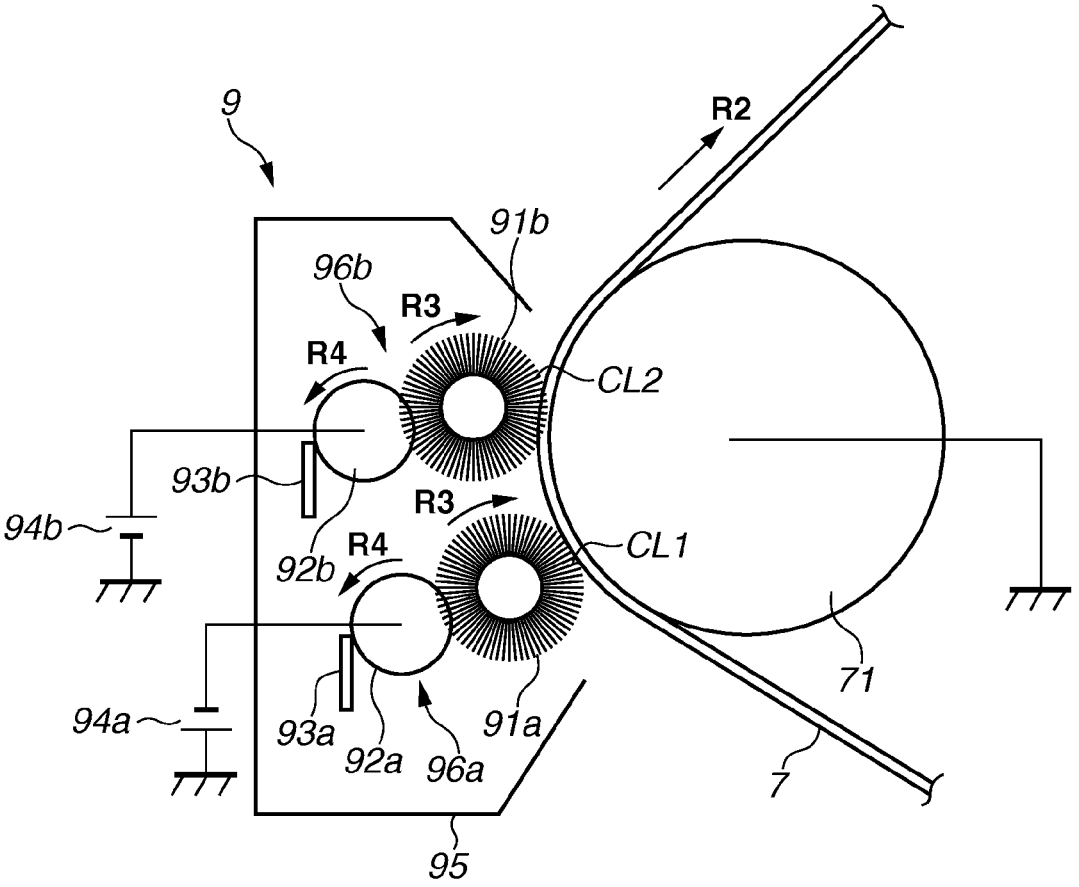
FIG. 3 is a cross-sectional view illustrating an overview of a belt cleaning device.

In the present exemplary embodiment, the belt cleaning device 9 based on the electrostatic cleaning method that electrostatically removes the toner is used as the intermediate transfer member cleaning unit. FIG. 3 is a cross-sectional view schematically illustrating the belt cleaning device 9 according to the present exemplary embodiment. The belt cleaning device 9 is disposed upstream of the primary transfer portion T1 (more specifically, the primary transfer portion T1Y located most upstream) and downstream of the secondary transfer portion T2 in the conveyance direction of the intermediate transfer belt 7.

The belt cleaning device 9 includes a housing 95 disposed close to the intermediate transfer belt 7. The belt cleaning device 9 includes an upstream fur brush 91*a* as a first collection member disposed upstream in the conveyance direction of the intermediate transfer belt 7, and a downstream fur brush 91*b* as a second collection member disposed downstream in the conveyance direction of the intermediate transfer belt 7, inside the housing 95. The upstream fur brush 91*a* and the downstream fur brush 91*b* form a first electrostatic cleaning portion CL1 and a second electrostatic cleaning portion CL2 that collect the toner from the intermediate transfer belt 7 by contacting the intermediate transfer belt 7 at positions opposing the driving roller 71 via the intermediate transfer belt 7, respectively. Further, the belt cleaning device 9 includes an upstream bias roller 92*a* as a first voltage application member in contact with the upstream fur brush 91*a*, and a downstream bias roller 92*b* as a second voltage application member in contact with the downstream fur brush 91*b*, inside the housing 95. Further, the belt cleaning device 9 includes an upstream blade 93*a* as a first removal member in abutment with the upstream bias roller 92*a*, and a downstream blade 93*b* as a second removal member in abutment with the downstream bias roller 92*b*, inside the housing 95.

The upstream and downstream fur brushes 91*a* and 91*b* each are a conductive fur brush formed by providing carbon-dispersed nylon fibers having a bristle resistance value of 0.3 M (Ω/cm) and a fiber thickness of 6 denier onto a metallic roller (a core member) at a bristle density of five hundred thousand fibers/inch$^2$. In the present exemplary embodiment, the upstream and downstream fur brushes 91*a* and 91*b* each have a diameter of 32 mm. Further, the upstream and downstream bias rollers 92*a* and 92*b* each are embodied by an aluminum metallic roller. In the present exemplary embodiment, the upstream and downstream bias rollers 92*a* and 92*b* each have a diameter of 20 mm. Further, the upstream and downstream blades 93*a* and 93*b* each are embodied by a plate-shaped member made of a urethane rubber. In this manner, in the present exemplary embodiment, an upstream cleaning member 96*a* as a first cleaning member includes the upstream fur brush (cleaning brush) 91*a*, the upstream bias roller 92*a*, and the upstream blade 93*a*. Further, in the present exemplary embodiment, a downstream cleaning member 96*b* as a second cleaning member includes the downstream fur brush (cleaning brush) 91*b*, the downstream bias roller 92*b*, and the downstream blade 93*b*. Then, these upstream and downstream cleaning members 96*a* and 96*b* are disposed in parallel along the conveyance direction of the intermediate transfer belt 7.

The upstream and downstream fur brushes 91*a* and 91*b* are disposed so as to be brought into slidable contact with the intermediate transfer belt 7 while maintaining inroad amounts of approximately 1.0 mm into the intermediate transfer belt 7. The upstream and downstream fur brushes 91*a* and 91*b* are rotationally driven by driving motors (not illustrated) as driving units in directions indicated by arrows R3 in FIG. 3 at a speed (circumferential speed) of 50 mm/second. These movement directions indicated by the arrows R3 are reverse directions of the movement direction of the intermediate transfer belt 7 at the first and second electrostatic cleaning portions CL1 and CL2. The upstream and downstream bias rollers 92*a* and 92*b* are disposed so as to maintain inroad amounts of approximately 1.0 mm into the upstream and downstream fur brushes 91*a* and 91*b*, respectively. The upstream and downstream bias rollers 92*a* and 92*b* are rotationally driven by driving motors (not illustrated) as driving units in directions indicated by arrows R4 in FIG. 3 at similar speeds (circumferential speeds) to the upstream and downstream fur brushes 91*a* and 91*b*, respectively. These movement directions indicated by the arrows R4 are reverse directions of the movement directions of the upstream and downstream fur brushes 91*a* and 91*b* at portions where the upstream and downstream bias rollers 91*a* and 91*b* are in contact with the upstream and downstream fur brushes 91*a* and 91*b*, respectively. The upstream and downstream blades 93*a* and 93*b* are disposed so as to maintain inroad amounts of approximately 1.0 mm into the upstream and downstream bias rollers 92*a* and 92*b*, respectively. The upstream and downstream blades 93*a* and 93*b* are in contact (counter abutment) with the upstream and downstream bias rollers 92*a* and 92*b* in such a manner that free ends thereof are located upstream of fixed ends thereof in the rotational directions of the upstream and downstream bias rollers 92*a* and 92*b*, respectively.

A direct-current voltage negative in polarity is applied as a cleaning bias (a cleaning voltage) from a first cleaning power source 94*a* as a voltage application unit to the upstream bias roller 92*a*. Further, a direct-current voltage positive in polarity is applied as a cleaning bias from a second cleaning power source 94*b* as a voltage application unit to the downstream bias roller 92*b*. The first and second cleaning power sources 94*a* and 94*b* apply the cleaning biases under constant current control so as to cope with the potentials on the intermediate transfer belt 7 and the upstream and downstream fur brushes 91*a* and 91*b* under various conditions. In the present exemplary embodiment, as a current value of each of the cleaning biases, a suitable current value is predetermined for each of cleaning performances at the time of normal image formation and at the time of cleaning for the patch that will be described below, and the cleaning bias is applied under the constant current control so as to achieve a flow of this current.

An operation performed when the transfer residual toner on the intermediate transfer belt 7 is cleaned will be described now. The application of the cleaning bias negative in polarity (−) to the upstream bias roller 92*a* leads to generation of a potential difference between the intermediate transfer belt 7 and the upstream fur brush 91*a*. Through this difference, toner charged positively in polarity (+) in the transfer residual toner on the intermediate transfer belt 7 is attracted and transferred onto the upstream fur brush 91*a* side. This toner attracted and transferred onto the upstream fur brush 91*a* is transferred from the upstream fur brush 91*a* to the upstream bias roller 92*a* due to a potential difference between the upstream fur brush 91*a* and the upstream bias roller 92*a*. Then, this toner transferred onto the upstream bias roller 92*a* is swept down from the upstream bias roller 92*a* by the upstream blade 93*a* to be collected into a collected toner container formed in the housing 95.

Even after the transfer residual toner on the intermediate transfer belt 7 is cleaned by the upstream cleaning member 96*a*, non-polar toner and toner charged negatively in polarity (−) remain on the intermediate transfer belt 7. These kinds of toner are charged negatively in polarity (−) by the cleaning bias negative in polarity that is applied to the upstream fur brush 91*a*. It is considered that the toner is charged by charge injection or electric discharge.

Then, the application of the cleaning bias positive in polarity (+) to the downstream bias roller 92*b* leads to generation of a potential difference between the intermediate transfer belt 7 and the downstream fur brush 91*b*, thereby allowing this remaining toner to be attracted and transferred onto the downstream fur brush 91*b*. This toner attracted and transferred onto the downstream fur brush 91*b* is transferred from the downstream fur brush 91*b* to the downstream bias roller 92*b* due to a potential difference between the downstream fur brush 91*b* and the downstream bias roller 92*b*. Then, this toner transferred onto the downstream bias roller 92*b* is swept down from the downstream bias roller 92*b* by the downstream blade 93*b*. In this manner, the transfer residual toner remaining on the intermediate transfer belt 7 can be sufficiently removed and collected.

Next, an operation performed when the patch is cleaned will be described. When the patch passes through the secondary transfer portion T2, the secondary transfer roller 8 is separated from the intermediate transfer belt 7. The toner of the patch is not transferred to the transfer medium P, and is conveyed to the first and second electrostatic cleaning portions CL1 and CL2. Therefore, most of the toner of the patch is charged negatively in polarity (−). This toner of the patch that is charged negatively in polarity (−) is little collected by the upstream cleaning member 96*a* to which the cleaning bias negative in polarity (−) is applied, and is collected by the downstream cleaning member 96*b* to which the cleaning bias positive in polarity (+) is applied.

In the present exemplary embodiment, during execution of an adjustment operation with use of the patch, the secondary transfer roller 8 is separated from the intermediate transfer belt 7 before the patch transferred onto the intermediate transfer belt 7 reaches the secondary transfer portion T2. This separation prevents the toner of the patch from being transferred to the secondary transfer roller 8. However, the present invention is not limited to this configuration. In a case of a configuration that does not allow the secondary transfer roller 8 to be separated from the intermediate transfer belt 7, the following method can be employed. Specifically, when the toner of the patch passes through the secondary transfer portion T2, a secondary transfer bias having a negative polarity, which is an opposite polarity from the normal image formation, is applied to the secondary transfer roller 8. This application prevents the toner of the patch from being transferred to the secondary transfer roller 8 with the aid of an electric field generated at the secondary transfer portion T2.

3. Adjustment Operation 3-1. Patch Sensor

The image forming apparatus 100 according to the present exemplary embodiment includes an on-belt patch sensor 150 and the on-drum patch sensor 160 as detection units for detecting the patch that is an adjustment toner image for use in the adjustment operation of the image forming apparatus 100. More specifically, in the present exemplary embodiment, a patch reading unit is embodied by using the two sensors of on-belt patch sensor 150 and on-drum patch sensor 160. The on-belt patch sensor 150 is disposed so as to detect a patch on the intermediate transfer belt 7 on a downstream side of the primary transfer portion T1 of the most downstream fourth image forming unit SK and an upstream side of the secondary transfer portion T2 (at a portion opposing the tension roller 72 in the present exemplary embodiment). Further, the on-drum patch sensor 160 is disposed so as to detect a patch on the photosensitive drum 1K of the fourth image forming unit SK on a downstream side of the position where the development sleeve and the photosensitive drum 1K are located opposing each other (the development portion), and a upstream side of the primary transfer portion T1 in the rotational direction of the photosensitive drum 1K. This layout allows the on-drum patch sensor 160 to carry out the detection without the patch being disturbed at the primary transfer portion T1.

Figure 8:
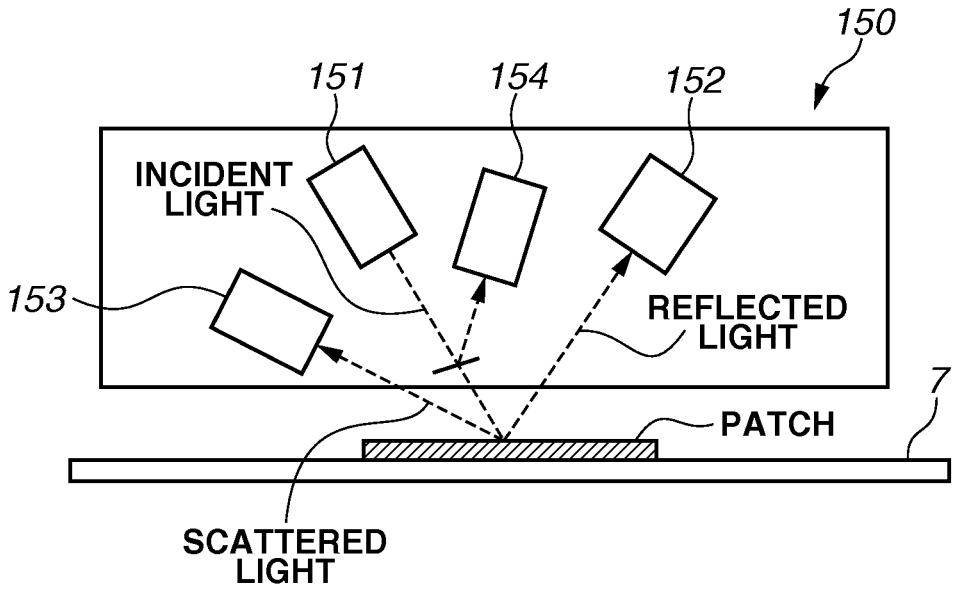
FIG. 8 is a schematic diagram illustrating a patch sensor.

FIG. 8 is a schematic diagram illustrating an overview of a configuration of the on-belt patch sensor 150. The on-belt patch sensor 150 emits light from a light-emitting diode (LED) light source 151, and detects reflected light amounts of a specular reflection component and a diffused reflection component regarding light components reflected from the surface of the intermediate transfer belt 7 by a first photosensor 152 and a second photosensor 153, respectively. In the present exemplary embodiment, the on-belt patch sensor 150 detects patches of the three color components of yellow, magenta, and cyan colors. Especially, when detecting the density of the patch, the on-belt patch sensor 150 calculates the density (a toner amount) based on a difference between a reflected light amount component of the surface of the intermediate transfer belt 7 and a reflected light amount component of the patch portion. In the present exemplary embodiment, an LED configured to output a wavelength of 940 nm is used as the LED light source 151 of the on-belt patch sensor 150. It is desirable to use a wavelength range that is not absorbed by any of the above-described color components as the light source, because the density of the patch in the visible range is supposed to be detected for any of the yellow, magenta, and cyan colors.

The on-drum patch sensor 160 is configured similarly to the above-described on-belt patch sensor 150. On the other hand, in the present exemplary embodiment, the on-drum patch sensor 160 detects the density (the toner amount) based on the diffused reflection component, because the on-drum patch sensor 160 detects a patch of a color component of the black color. In the present exemplary embodiment, an LED configured to output a wavelength of 880 nm is used as an LED light source of the on-drum patch sensor 160. The photosensitive drum 1K is exposed by this LED light source although this is only when the patch is read, whereby it is desirable to use a wavelength range to which the photosensitive drum 1K is less sensitive when the photosensitive drum 1K is exposed, and therefore it is desirable to use a near-infrared wavelength range.

3-2. Patch

Next, the patch will be described. In the present exemplary embodiment, the yellow, magenta, and cyan patches transferred onto the intermediate transfer belt 7 are detected by the on-belt patch sensor 150. Further, in the present exemplary embodiment, the black patch is detected on the photosensitive drum 1K by the on-drum patch sensor 160 before being transferred onto the intermediate transfer belt 7. For the yellow, magenta, and cyan patches on the intermediate transfer belt 7, the on-belt patch sensor 150 detects the density thereof based on the light amount of the scattered light component. Further, for the black patch, the on-drum patch sensor 160 detects the density thereof based on the light amount of the specularly reflected light component. Then, the image forming apparatus 100 adjusts an image density by adjusting the respective exposure devices 3 based on these detection results. An operation of forming the patch on the photosensitive drum 1, and an operation of transferring the patch from the photosensitive drum 1 onto the intermediate transfer belt 7 themselves are similar to the operations at the time of the normal image formation.

3-3. Patch Signal Value

Figure 9:
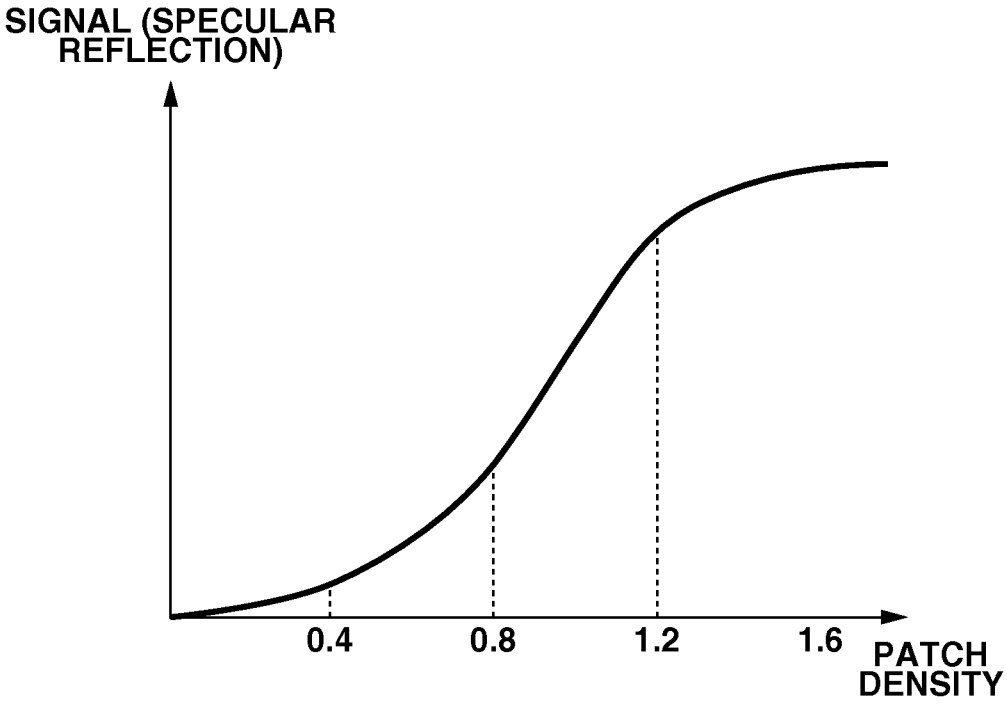
FIG. 9 is a graph indicating a signal of the patch sensor.

FIG. 9 is a graph indicating a behavior of a signal value of the specular reflection component detected by the on-belt patch sensor 150 with respect to the patch density. The amount of the specularly reflected light decreases as the patch density increases when the patch density is optically detected, whereby a difference between the amount of the light specularly reflected from the surface of the intermediate transfer belt 7 and the amount of the light specularly reflected when the patch is detected is indicated on a vertical axis in FIG. 9 as the signal.

In a high density range exceeding a certain level of density range, the signal exhibits a saturation behavior of no longer linearly increasing even when the patch density increases. The reason therefor is considered to be as follows. To form a toner image, toner particles are stacked onto the photosensitive drum 1 or the intermediate transfer belt 7 corresponding to the electrostatic latent image, thereby forming the image. However, when a large number of toner particles are stacked in many layers to increase the density, the amount of the reflected light is no longer changed largely. Further, the signal also has low linearity with respect to the patch density, when the patch is formed at an extremely low density. The reason therefor is considered to be as follows. In a case where an extremely low density patch image is formed, when layers of toner are stacked corresponding to the electrostatic latent image, the toner particles are only sparsely arrayed. On the other hand, the on-belt patch sensor 150 is affected by the surface of the intermediate transfer belt 7 because the on-belt patch sensor 150 detects the amount of the reflected light within a detection range of several millimeters. The same also applies to the on-drum patch sensor 160.

For the above-described reasons, the accuracy of the density detection for the patch density is considered to decrease in the high density range where the signal value is saturated with respect to the patch density to thereby impair the linearity, and in the extremely low density range. Therefore, in the present exemplary embodiment, five tones indicated by 8-bit input signal values of 32, 96, 128, 192, and 255, which cover densities of 0.4, 0.8, and 1.2, are targeted as the patch density.

3-4. Patch Shape

Figure 5A:
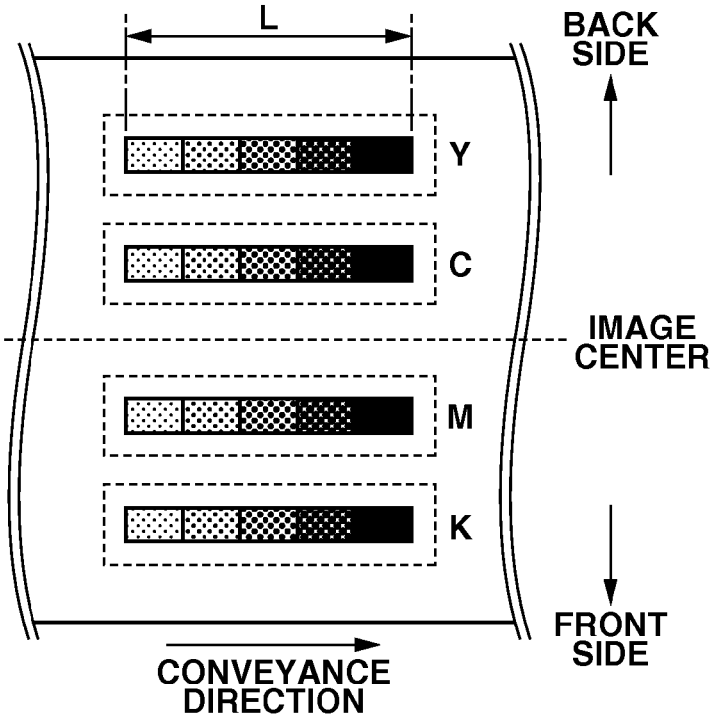
FIGS. 5A and 5B are schematic views each illustrating one example of patches or a patch for an image density adjustment.
Figure 5B:
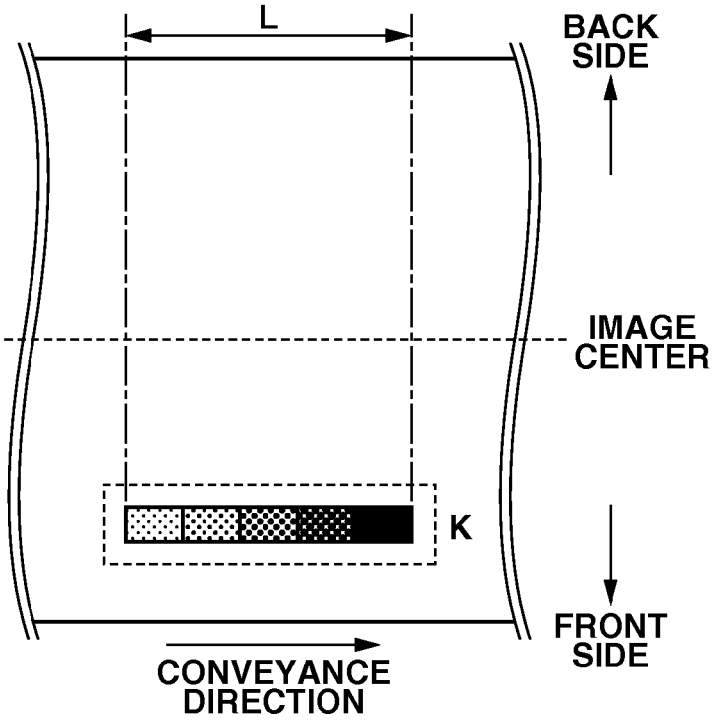

FIGS. 5A and 5B are schematic diagrams each illustrating the patch(es) formed on the intermediate transfer belt 7 during a single image density adjustment according to the present exemplary embodiment. Assume that a front side in FIGS. 5A and 5B is a front side of the image forming apparatus 100 in FIG. 1 that corresponds to the front side of the sheet of FIG. 1, and a back side in FIGS. 5A and 5B is an opposite side therefrom. A front-back direction connecting this front side and the back side corresponds to the longitudinal direction of the photosensitive drum 1 (a main scanning direction).

At the time of the image density adjustment in the full color mode, the patches of the respective black, magenta, cyan, and yellow colors are formed at positions in alignment with one another in the main scanning direction from the front side to the back side in this order, as illustrated in FIG. 5A. The patch of each color includes five patches that have the five tones indicated by the 8-bit input signal values of 32, 96, 128, 192, and 255 as described above, respectively, and are continuously formed in the conveyance direction of the intermediate transfer belt 7. Further, at the time of the image density adjustment for different screens, two types of the above-described five patches may be continuously formed for each color, so that ten patches may be formed in total for each color. In the present exemplary embodiment, the size of the single patch is 25 mm in the conveyance direction of the intermediate transfer belt 7, and 20 mm in the main scanning direction. However, the size of the patch may be any size that the sensor can read. In the present exemplary embodiment, for example, the formation of the ten patches results in generation of a patch length of 250 mm in the conveyance direction of the intermediate transfer belt 7 (a length from the beginning to the end of a patch formed region) at a single patch formation timing. The black patch is transferred onto the intermediate transfer belt 7 even in the full color mode as described above, but the black patch is detected on the photosensitive drum 1K by the on-drum patch sensor 160 before this transfer.

In the full color mode, the patches of the four colors are formed at the same time in parallel with one another in the main scanning direction as described above in consideration of the productivity. On the other hand, in the black monochrome mode, the yellow, magenta, and cyan patches are not necessary, whereby only the patch of the black color alone is formed as illustrated in FIG. 5B. Further, the detection of the black patch is completed by the on-drum patch sensor 160, and therefore the black patch is not required to be transferred onto the intermediate transfer belt 7. Therefore, at the time of the image density adjustment in the black monochrome mode, the bias to be applied to the primary transfer roller 5K of the fourth image forming unit SK is set in such a manner that a bias having an opposite polarity (hereinafter also referred to as an "opposite bias") from the normal primary transfer bias is applied to the primary transfer roller 5K. As a result, an opposite electric field with respect to the electric field at the time of the normal image formation is generated at the primary transfer portion T1K, so that most of the toner of the patch on the photosensitive drum 1K can be collected by the drum cleaning device 6 without being transferred onto the intermediate transfer belt 7. By the application of the opposite bias in this manner, the patch on the intermediate transfer belt 7, which is supplied to the first and second electrostatic cleaning portions CL1 and C12, has a density of approximately 1 to 10% of the patch density on the photosensitive drum 1K.

3-5. Automatic Toner Replenishment (ATR) Control

The patch used at the time of the image density adjustment has been described in the above description. In the present exemplary embodiment, an ATR patch illustrated in FIG. 6, which is a patch used for detecting a developing performance of the toner in ATR control that will be described below, is formed as a patch for use in an adjustment operation. For example, a single ATR patch is formed during a single ATR control operation, and the size thereof is set to 25 mm×20 mm, which is the same size as the size at the time of the above-described image density adjustment.

In the present exemplary embodiment, the two-component developer mainly including the non-magnetic toner and the magnetic carrier is used as the developer. As is known, a toner/developer (T/D) ratio (a ratio of a toner weight to a total weight of the carrier and the toner) and a toner charged amount of this two-component developer are important factors to stabilize an image quality. The toner in the developer is consumed at the time of the development, so that the T/D ratio of the developer decreases, and the toner charged amount increases at the same time, which leads to a reduction in the image density. Therefore, the following ATR control is employed. A developer density control device or an image density control device is used to detect the developer density or the image density at an appropriate timing, and replenish the toner according to a change therein, thereby controlling the T/D ratio or the image density to as a constant level as possible to maintain the image quality. It is desirable that the patch for this ATR control is a patch pattern formed at a halftone density to enable more accurate detection of a change in an engine characteristic. In the present exemplary embodiment, a patch for which a density signal is the 8-bit input signal value of 96 is used as this patch.

4. Control Configuration

Figure 4:
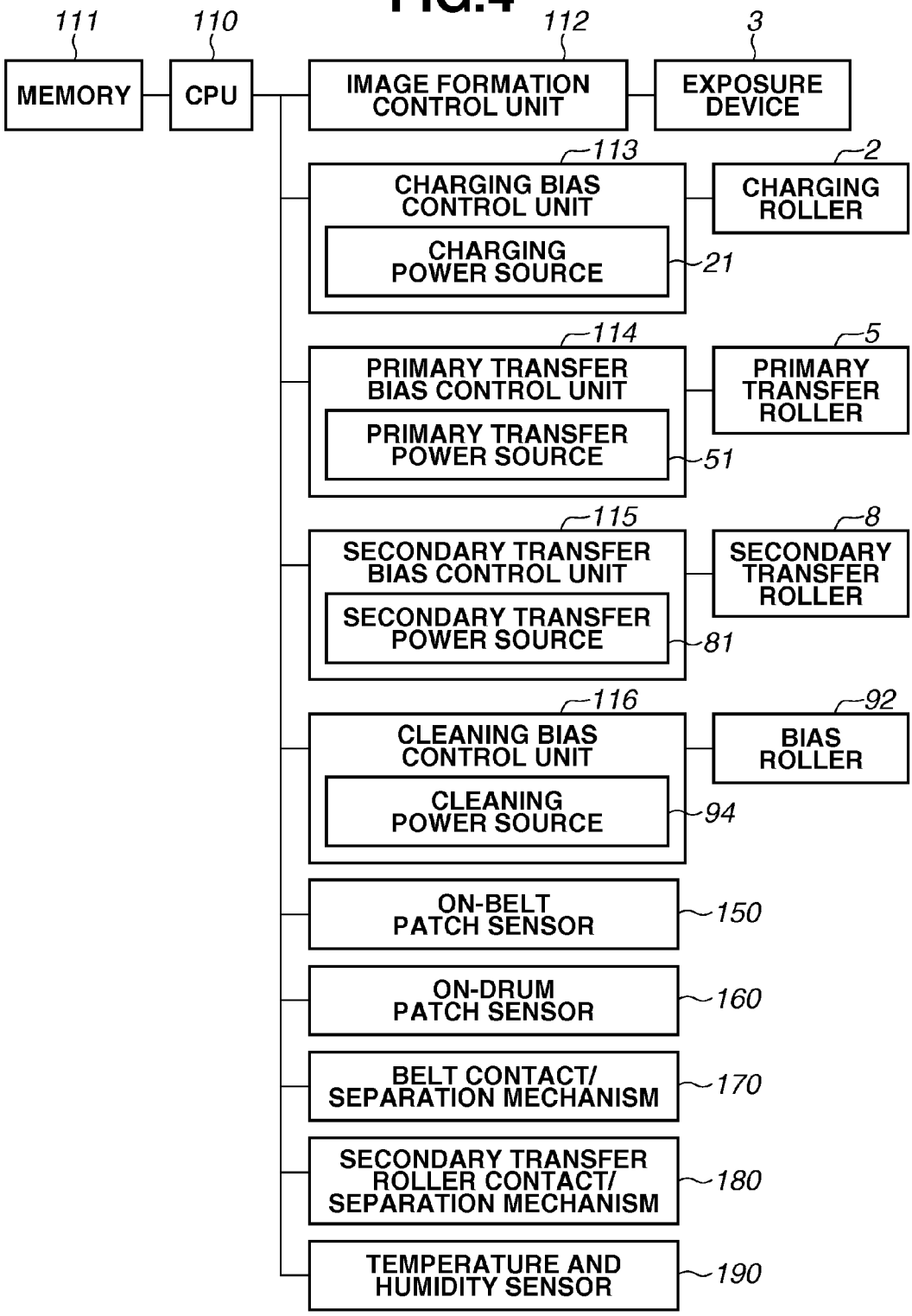
FIG. 4 is a control block diagram of main portions of the image forming apparatus.

FIG. 4 illustrates an overview of a control configuration of main portions of the image forming apparatus 100 according to the present exemplary embodiment. The image forming apparatus 100 includes a central processing unit (CPU) 110 as a control unit that comprehensively controls the image forming apparatus 100, and a memory 111 as a storage unit such as a read only memory (ROM) and a random access memory (RAM). The RAM stores a result of the detection by the sensor, a result of calculation, and the like. The ROM stores a control program, a predetermined data table, and the like. The CPU 110 controls an image formation control unit 112, a charging bias control unit 113, a primary transfer bias control unit 114, a secondary transfer bias control unit 115, a cleaning bias control unit 116, and the like in terms of a relationship with the present exemplary embodiment. Further, the CPU 110 controls the on-belt patch sensor 150, the on-drum patch sensor 160, the belt contact/separation mechanism 170, the secondary transfer roller contact/separation mechanism 180, a temperature and humidity sensor 190, and the like.

As will be described in detail below, the image formation control unit 112 controls an exposure timing of the exposure device 3 and the like. The charging bias control unit 113 can output a voltage controlled by constant voltage control from the charging power source 21 to the charging roller 2. More specifically, the charging bias control unit 113 includes a voltage detection unit that detects an output voltage value, and can perform the constant voltage control according to a setting voltage value under control by the CPU 110. Further, the primary transfer bias control unit 114 can output a voltage controlled by the constant current control and a voltage controlled by the constant voltage control from the primary transfer power source 51 to the primary transfer roller 5. More specifically, the primary transfer bias control unit 114 includes a current detection unit that detects a current value flowing when the voltage is applied to the primary transfer roller 5, and a voltage detection unit that detects an output voltage value. Then, the primary transfer bias control unit 114 can perform the constant current control and the constant voltage control on the bias to be applied to the primary transfer roller 5 by feeding back results of the detection to the CPU 110. The secondary transfer bias control unit 115 is also similar to the primary transfer bias control unit 114. Further, the cleaning bias control unit 116 can output a voltage controlled by the constant current control from the cleaning power source 94 to the bias roller 92. More specifically, the cleaning bias control unit 116 includes a current detection unit that detects a current value flowing when the voltage is applied to the bias roller 92. The cleaning bias control unit 116 can perform the constant current control on the bias to be applied to the bias roller 92 by feeding back a result of the detection to the CPU 110.

5. Cleaning Operation for Patch

Next, the cleaning operation for the patch will be described in further detail. The term "electrostatic cleaning" will be used to refer to an operation of removing the toner from the intermediate transfer belt 7 at the first and second electrostatic cleaning portions CL1 and C12 by the belt cleaning device 9. Further, the term "opposite bias cleaning" will be used to refer to an operation of removing the toner from the intermediate transfer belt 7 by transferring (reversely transferring) the toner from the intermediate transfer belt 7 onto the photosensitive drum 1 at the primary transfer portion T1, which will be described below.

Figure 7:
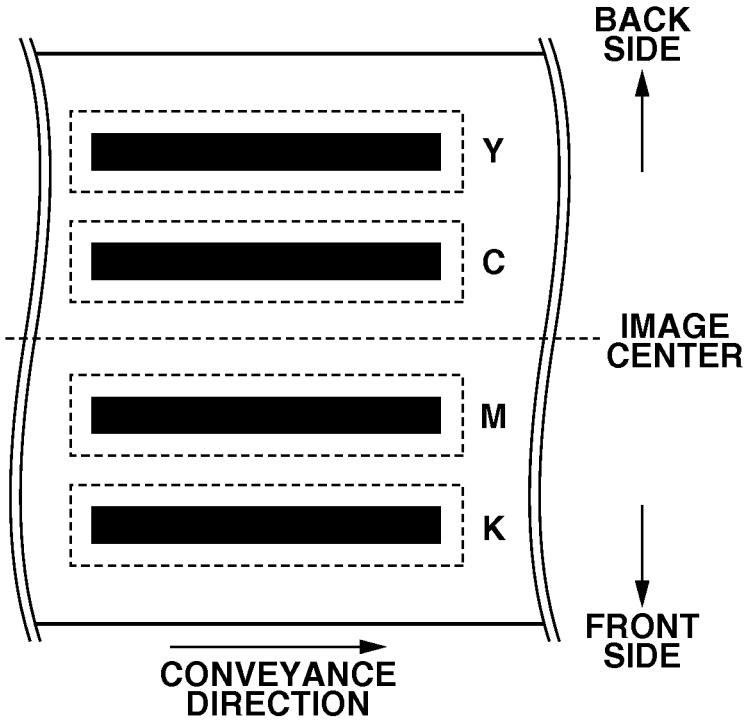
FIG. 7 is a schematic diagram illustrating patches for checking a density and a length of the patch, and the number of times of cleaning.

It has been found that there is a correlation between the toner amount and the length in the conveyance direction of the intermediate transfer belt 7 regarding the patch that can be removed by carrying out the electrostatic cleaning once. In some cases, carrying out the electrostatic cleaning once may be insufficient to remove the toner, especially when the above-described patch is formed on the intermediate transfer belt 7 so as to correspond to a large number of tones or at a high density to improve the accuracy of the density control at the time of the image density adjustment. Therefore, the required number of times of the cleaning was studied with respect to the patch density and the patch length in the configuration according to the present exemplary embodiment. At this time, densities and lengths were changed with use of patches illustrated in FIG. 7 in the configuration according to the present exemplary embodiment (same densities for the densities of the patches of the respective colors in a patch group formed for a single sample were used), and compared cleaning performances. The patches illustrated in FIG. 7 are formed in such a manner that patches of the respective black, magenta, cyan, and yellow colors at the same densities are arranged from the front side to the back side in this order, and the patches of the respective colors have equal lengths in the conveyance direction of the intermediate transfer belt 7. The densities and the lengths thereof were variously changed. It is desirable to set the setting current of the cleaning bias to an optimum setting value according to each environment. The present example will be described based on the optimum setting determined from an experiment carried out under an environment of a temperature set to 23° C. and a humidity set to 50%.

Figure 6:
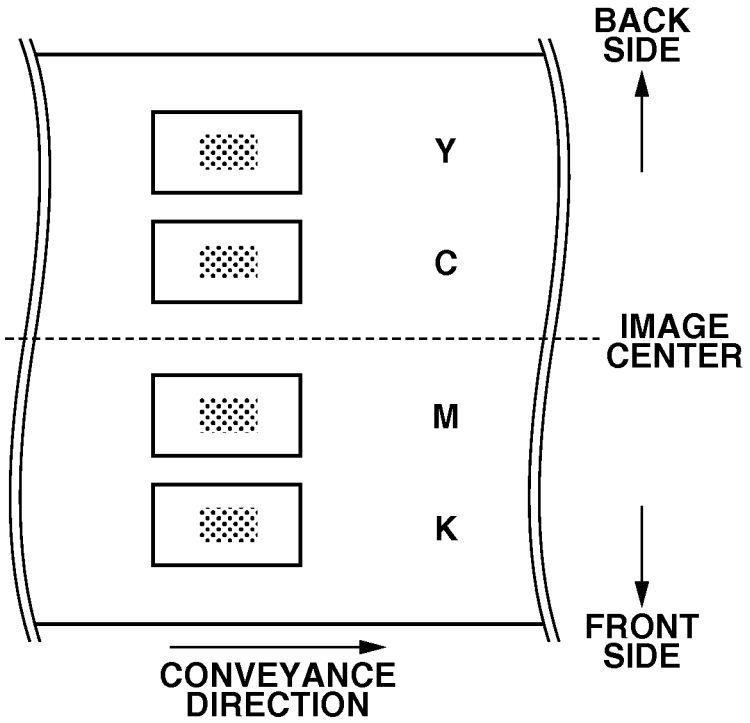
FIG. 6 is a schematic view illustrating one example of patches for Automatic Toner Replenishment (ATR) control.

The length of the patch in the conveyance direction of the intermediate transfer belt 7 is represented by a length (for example, a length L illustrated in FIGS. 5A and 5B) from the leading edge to the end of the transfer region (the patch transfer region) on the intermediate transfer belt 7 where a series of one or more patches are formed during a single adjustment operation. Examples of this series of patches include a plurality of patches continuously formed without a gap being generated therebetween in the conveyance direction of the intermediate transfer belt 7, and also include a plurality of patches continuously formed at different densities while being spaced apart at predetermined intervals. The above-described patches of the respective colors illustrated in FIGS. 5A, 5B, and 6 are typical examples of this series of patches.

First, it was studied whether the toner of the patch was able to be sufficiently removed by the electrostatic cleaning during a first rotation of the intermediate transfer belt 7. Next, it was studied whether toner unable to be removed by the electrostatic cleaning during the first rotation was able to be sufficiently removed by applying the opposite bias to each of the primary transfer rollers 5Y to 5K to collect the toner onto each of the photosensitive drums 1Y to 1K when the toner passed through each of the primary transfer portions T1Y to T1K after that. Next, it was studied whether toner still unable to be removed even after that was able to be sufficiently removed by the electrostatic cleaning during a second rotation. If there was still toner unable to be removed even after that, the cleaning was repeated in a similar manner after that, and the cleaning was continued until the toner of the patch was sufficiently removed. In the present example, completion of the cleaning is defined to mean that the toner of the patch can be removed sufficiently to an allowable degree.

Figure 10:
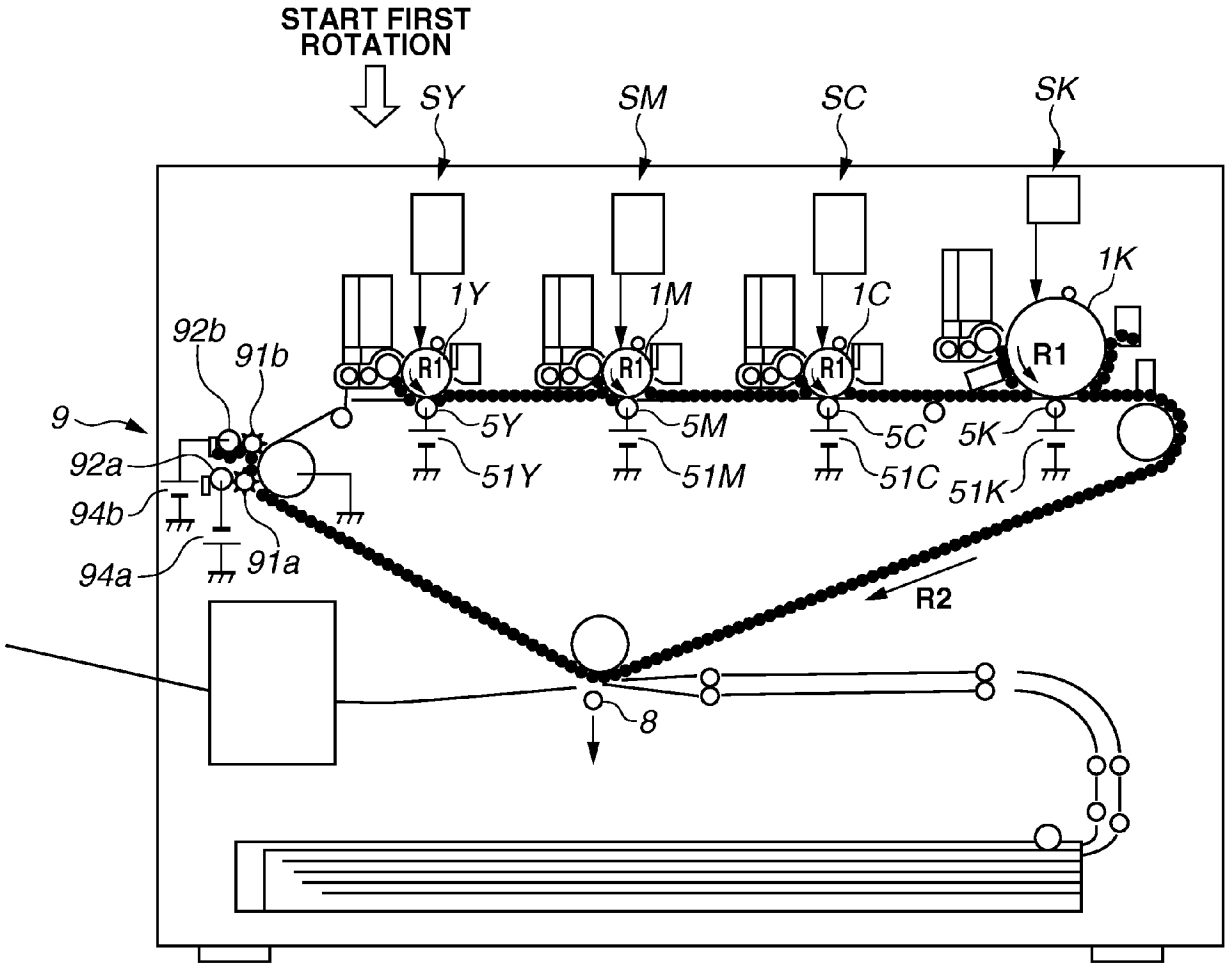
FIG. 10 is a schematic diagram illustrating a cleaning operation for the patch.
Figure 11:
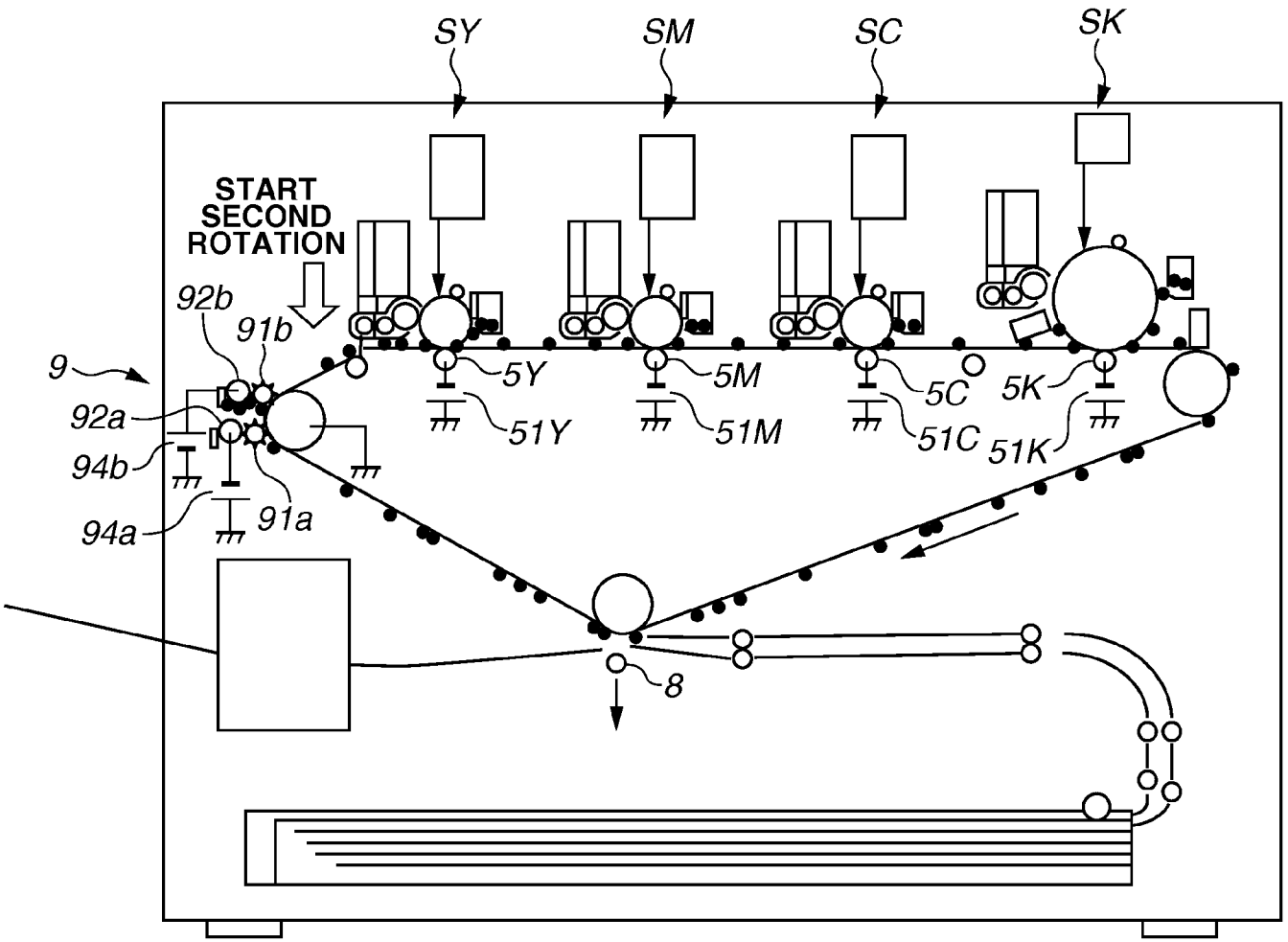
FIG. 11 is a schematic diagram illustrating a cleaning operation for the patch.
Figure 12A:
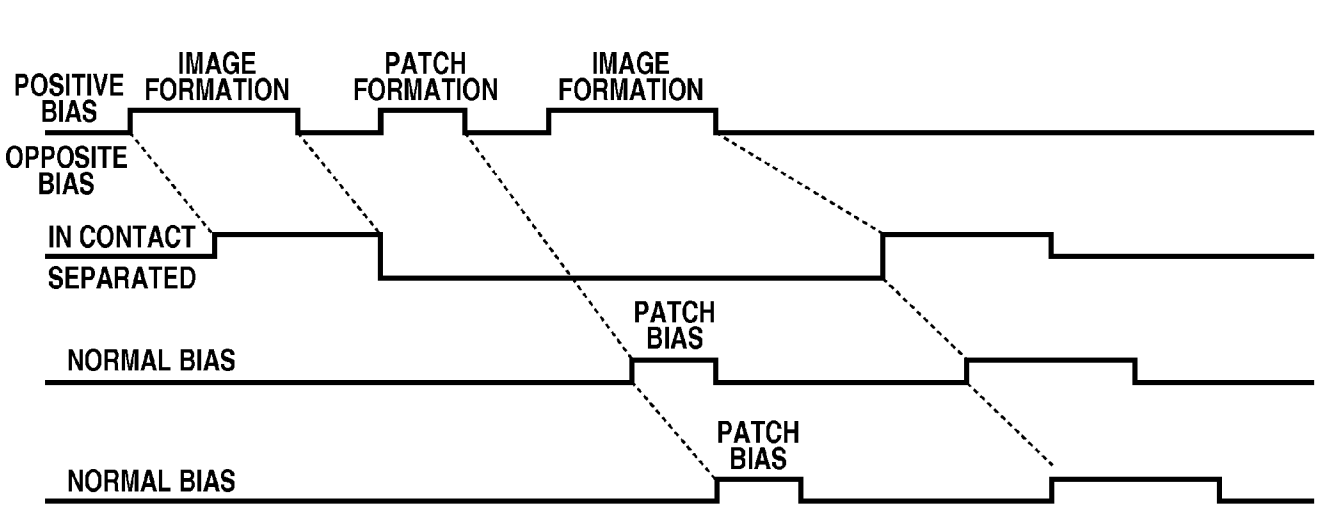
FIGS. 12A and 12B are sequence diagrams each illustrating a cleaning operation for the patch.
Figure 12B:
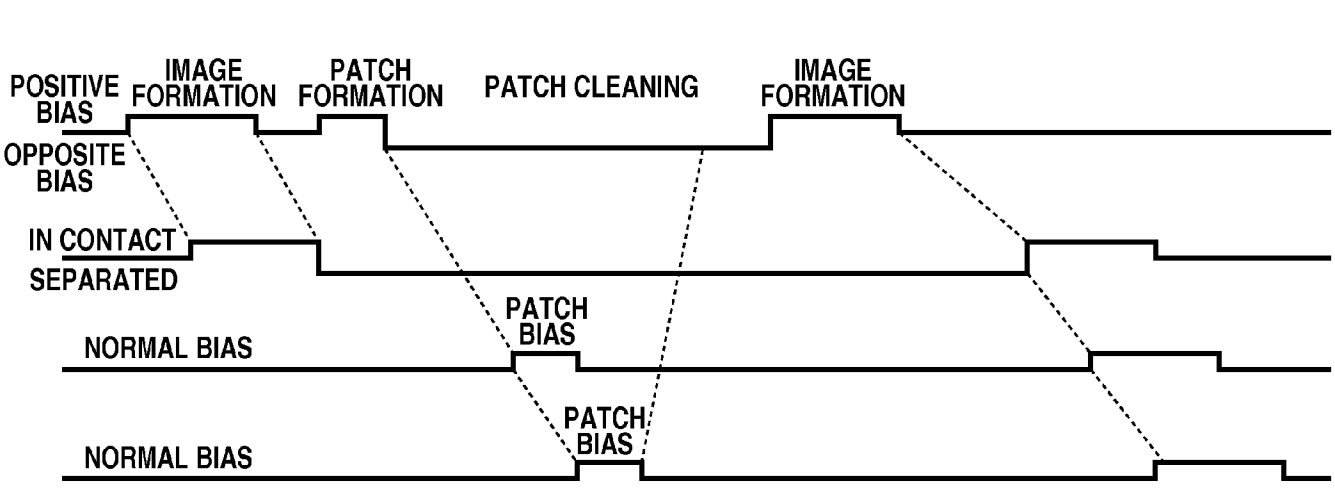
Figure 13A:
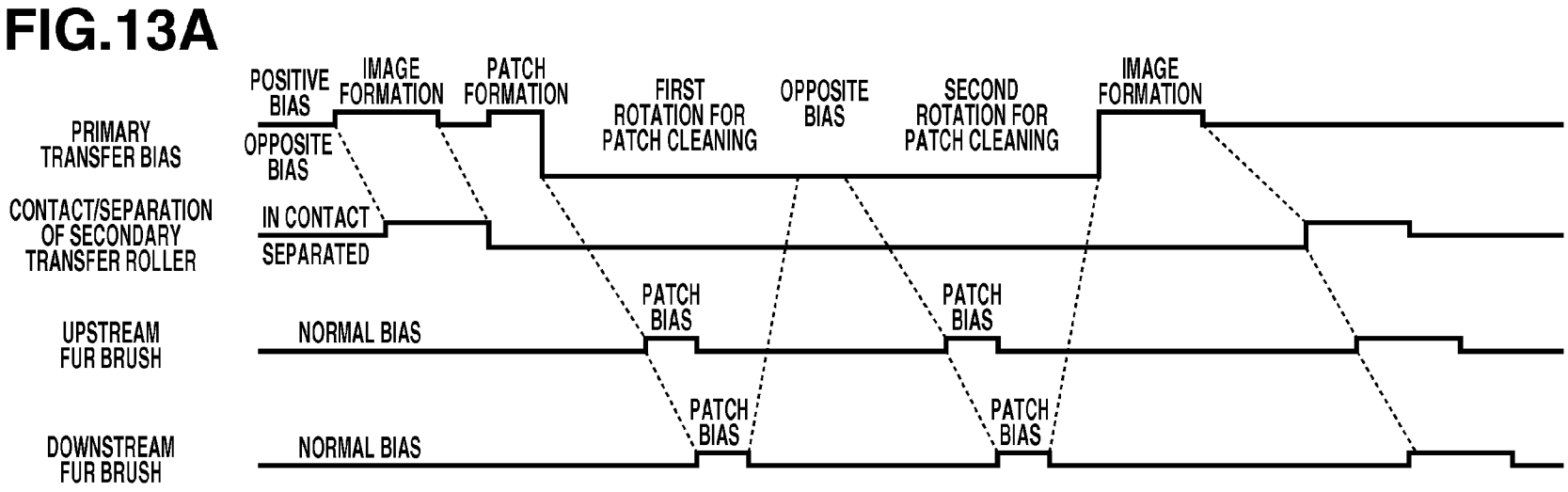
FIGS. 13A and 13B are sequence diagrams each illustrating a cleaning operation for the patch.
Figure 13B:
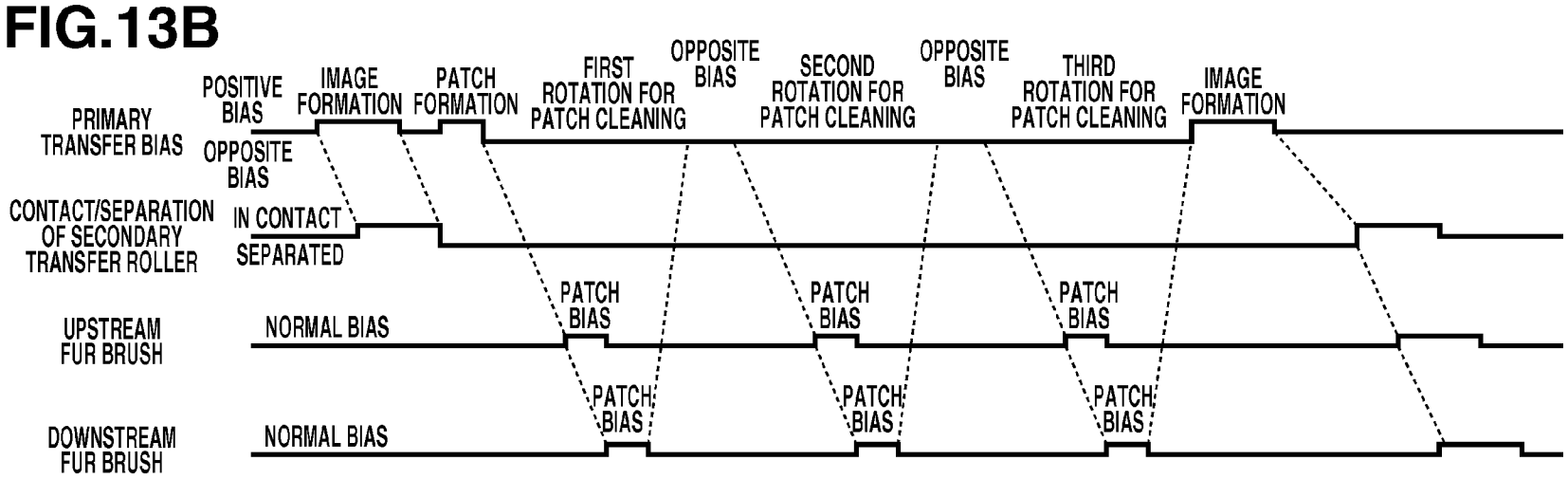

FIGS. 10 and 11 are schematic diagrams illustrating the electrostatic cleaning during the first and second rotations, respectively. Black circles on the intermediate transfer belt 7 and the like illustrated in FIGS. 10 and 11 schematically represent the toner. Further, FIGS. 12A and 12B illustrate sequences when the cleaning is completed by the electrostatic cleaning during the first rotation, and when the cleaning is completed by the opposite bias cleaning during the first rotation after the electrostatic cleaning during the first rotation, respectively. Similarly, FIGS. 13A and 13B illustrate sequences when the cleaning is completed by the opposite bias cleaning during the second rotation after the electrostatic cleaning during the second rotation, and when the cleaning is completed by the opposite bias cleaning during a third rotation after the electrostatic cleaning during the third rotation, respectively.

First, referring to FIG. 10, the patch formed on each of the photosensitive drums 1Y to 1K is transferred onto the intermediate transfer belt 7 at each of the primary transfer portions T1Y to T1K. The secondary transfer roller 8 is separated from the intermediate transfer belt 7, whereby the patch is not affected by the secondary transfer unlike during the image formation. Therefore, the toner forming the patch exhibits such a distribution of the charged amount that toner negative in polarity accounts for a large percentage while toner positive in polarity little exists. Therefore, most of the toner of the patch is electrostatically collected by the downstream fur brush 91*b* at the downstream cleaning member 96*b* to which the cleaning bias positive in polarity is applied. In the present exemplary embodiment, the cleaning bias negative in polarity is applied to the upstream cleaning member 96*a*, and the cleaning bias positive in polarity is applied to the downstream cleaning member 96*b*. However, the order of the polarity of the cleaning bias may be exchanged between the upstream cleaning member 96*a* and the downstream cleaning member 96*b*. The toner negative in polarity that is electrostatically collected onto the downstream fur brush 91*b* at the downstream cleaning member 96*b* is mostly transferred onto the downstream bias roller 92*b* when contacting the downstream bias roller 92*b*, and is removed by the downstream blade 93*b*. On the other hand, toner negative in polarity that is not transferred onto the downstream bias roller 92*b* is elastically caught by the downstream fur brush 91*a*, and remains attached to the brush bristles of the downstream fur brush 91*b*. Further, regarding remaining toner unable to be elastically collected from the intermediate transfer belt 7 onto the downstream fur brush 91*b*, toner negative in polarity therein becomes relatively strongly negative in polarity by being further provided with a charge negative in polarity while toner positive in polarity therein relatively shifts to the negative polarity side due to the negative current. The cleaning bias to be applied to each of the upstream and downstream bias rollers 92*a* and 92*b* in the electrostatic cleaning for the toner of the patch during the first rotation is applied under the constant current control, and a target current value thereof is changed according to each absolute humidity (refer to a table 1, which will be provided below). If the cleaning is completed by the electrostatic cleaning during the first rotation, the normal image forming sequence can start immediately after the formation of the patch is completed. FIG. 12A illustrates a sequence in this case.

Next, referring to FIG. 11, if the cleaning is not completed by the electrostatic cleaning during the first rotation, the toner of the patch is subjected to the opposite bias cleaning after that. More specifically, when the toner of the patch passes through each of the primary transfer portions T1Y to T1K, the bias negative in polarity (the opposite bias) is applied from each of the primary transfer power sources 51 to each of the primary transfer rollers 5Y to 5K. At this time, the charging bias is applied to each of the charging rollers 2Y to 2K, by which each of the photosensitive drums 1Y to 1K is charged. This application should be set in such a manner that an opposite electric field from the electric field generated at the time of the image formation is applied from each of the primary transfer rollers 5Y to 5K to each of the photosensitive drums 1Y to 1K to enable the toner negative in polarity that remains on the intermediate transfer belt after the electrostatic cleaning during the first rotation to be collected onto each of the photosensitive drums 1Y to 1K. This can be achieved by establishing a contrast potential positive in polarity on each of the photosensitive drums 1Y to 1K (in other words, by making the potential on the photosensitive drum 1 higher toward an opposite polarity side from the charged polarity of the toner (the negative polarity in the present exemplary embodiment) than the potential on the primary transfer roller 5). To satisfy this condition, the surface potential of each of the photosensitive drums 1Y to 1K should be made relatively higher than the bias applied to each of the primary transfer rollers 5Y to 5K. Therefore, a higher charging bias should be applied to each of the charging rollers 2*a* to 2*b* than the primary transfer bias applied to each of the primary transfer rollers 5Y to 5K. This arrangement enables the toner of the patch unable to be collected by the electrostatic cleaning during the first rotation to be collected onto each of the photosensitive drums 1Y to 1K. FIG. 12B illustrates a sequence in this case.

If there is still remaining toner unable to be collected even after that, the toner of the patch is subjected to the electrostatic cleaning again after passing through each of the primary transfer portions T1Y to T1K of the image forming units 1Y to 1K. The cleaning bias positive in polarity is applied to the downstream cleaning member 96*b* in a similar manner to the operation at the time of the electrostatic cleaning during the first rotation. At this time, most of the patch toner negative in polarity has been already collected onto each of the photosensitive drums 1Y to 1K at the primary transfer portions T1Y to T1K of the image forming units SY to SK by the opposite bias cleaning during the first rotation. Therefore, the most of toner remaining on the intermediate transfer belt 7 is toner relatively weakly negative in polarity. Therefore, the distribution of the charged amount of the toner relatively shifts to the positive polarity side compared to the distribution during the first rotation, whereby application of a higher cleaning bias than the first rotation would cause the polarity of the toner relatively weakly negative in polarity to be reversed to become a positive polarity, making the cleaning difficult. Therefore, the toner can be effectively collected by applying a lower cleaning bias to the downstream cleaning member 96*b* at the time of the electrostatic cleaning during the second rotation than the first rotation. The cleaning bias is applied to each of the upstream and downstream bias rollers 92*a* and 92*b* in the electrostatic cleaning for the toner of the patch during the second rotation under the constant current control, and a target current value thereof is changed according to each absolute humidity (refer to the table 1, which will be provided below). FIG. 13A illustrates a sequence in this case.

If the cleaning is still not completed by the electrostatic cleaning during the second rotation, the third rotation for the electrostatic cleaning is carried out. FIG. 13B illustrates a sequence in this case. The same applies to a fourth rotation and rotations after that.

In the present exemplary embodiment, the cleaning bias is controlled by the constant current control at the time of the cleaning for the patch. Further, the target current values in the electrostatic cleaning during the first rotation, the second rotation, and the third rotation, and the voltage values of the biases applied to each of the charging rollers 2Y to 2K and each of the primary transfer rollers 5Y to 5K in the opposite bias cleaning at the time of the cleaning for the patch are set as indicated by the table 1.

TABLE 1

| | CURRENT APPLIED IN ELECTROSTATIC CLEANING DURING FIRST ROTATION | | CURRENT APPLIED IN ELECTROSTATIC CLEANING DURING SECOND ROTATION | | CURRENT APPLIED IN ELECTROSTATIC CLEANING DURING THIRD AND SUBSEQUENT ROTATIONS | | PRIMARY TRANSFER PORTION T1 | | |
|---|---|---|---|---|---|---|---|---|---|
| ABSOLUTE HUMIDITY (g/Kg) | UPSTREAM (μA) | DOWN-STREAM (μA) | UPSTREAM (μA) | DOWN-STREAM (μA) | UPSTREAM (μA) | DOWN-STREAM (μA) | CONTRAST POTENTIAL (V) | CHARGING VOLTAGE (V) | PRIMARY TRANSFER VOLTAGE (V) |
| 0 TO 5 | −5 | +10 | −5 | +8 | −5 | +5 | 1500 | −1000 | −2500 |
| 5 TO 10 | −8 | +15 | −5 | +10 | −5 | +8 | 1500 | −1000 | −2500 |
| 10 TO 15 | −10 | +20 | −5 | +15 | −5 | +10 | 1300 | −1000 | −2500 |
| 15 TO 20 | −10 | +20 | −5 | +15 | −5 | +10 | 1200 | −1000 | −2500 |
| 20 OR HIGHER | −15 | +25 | −5 | +20 | −5 | +15 | 1000 | −1000 | −2500 |

Each time the cleaning is repeated, the distribution of the charged amount of the remaining toner is relatively shifting toward the positive polarity side as described above. Therefore, each time the opposite bias cleaning is repeated, the contrast potential can be further reduced (in other words, each time the opposite bias cleaning is repeated, the potential on the photosensitive drum 1 can be further increased toward the polarity side corresponding to the charged polarity of the toner (the negative polarity in the present exemplary embodiment). Thus, the bias to be applied to the primary transfer roller 5 may be changed, the bias to be applied to the charging roller 2 may be changed, or both of them may be changed. Further, in the present exemplary embodiment, the contrast potentials in the opposite bias cleaning are set to equal potentials at the respective stations of the image forming units SY to SK. However, the contrast potential can be changed to enable the toner to be collected with a different degree of weight set on each of the image forming units S.

Next, control of the cleaning operation for the patch will be further described with reference to the block diagram illustrated in FIG. 4 and the sequences illustrated in FIGS. 12A, 12B, 13A, and 13B.

The photosensitive drum 1 rotates at the predetermined rotational speed during the image formation. Therefore, it takes a constant time from the exposure of the photosensitive drum 1 by the exposure device 3 and the formation of the electrostatic latent image until the primary transfer of the toner image onto the intermediate transfer belt 7. During the image formation, the charging bias, the development bias, the primary transfer bias, and the cleaning bias continue being applied. Therefore, the image formation control unit 112 controls a timing at which the exposure device 3 exposes the photosensitive drum 1 to adjust an image formation timing or a patch formation timing under the control by the CPU 110. Then, the image formation control unit 112 controls the timing at which the patch is formed onto the photosensitive drum 1 in such a manner that the patch is formed on a space (also referred to as a "sheet-to-sheet space") between a toner image transfer region and a next toner image transfer region, each of which the toner image formed on the photosensitive drum 1 is transferred to on the intermediate transfer belt 7 as the primary transfer, each time a predetermined number of sheets are processed. In addition thereto, the image formation control unit 112 controls a timing at which an image is formed onto the photosensitive drum 1 next time, upon completion of cleaning the patch transfer region on the intermediate transfer belt 7 a predetermined number of times.

Further, the CPU 110 controls the cleaning bias control unit 116, thereby controlling the cleaning biases for the electrostatic cleaning to be the constant current. At this time, for example, the cleaning biases applied during the first rotation, the second rotation, and the third rotation are subjected to the constant current control so as to be the respective current values based on the table stored in the memory (non-volatile memory) 111 connected to the CPU 110. The respective setting values of the cleaning biases according to the absolute humidity at the time of the cleaning for the patch according to the present exemplary embodiment are as indicated in the table 1.

The CPU 110 sets the current values at this time to the predetermined values according to the absolute humidity calculated from the temperature and the humidity detected by the temperature and humidity sensor (environment sensor) 190 as an environment detection unit mounted in the apparatus main body of the image forming apparatus 100.

Further, the CPU 110 controls the charging bias control unit 113 and the primary transfer bias control unit 114 based on the table 1, thereby controlling the contrast potential (the biases applied to the charging roller 2 and the primary transfer roller 5, respectively) for the opposite bias cleaning. At this time, the charging bias and the primary transfer bias are respectively controlled so as to be sequentially set to predetermined outputs every time a predetermined time period has elapsed, according to a timing at which the patch transfer region on the intermediate transfer belt 7 passes through the primary transfer portion T1. Then, upon determining the completion of cleaning the patch transfer region the predetermined number of times, the image formation control unit 112 continuously controls the image formation timing, and continues the image formation. At the time of the patch formation, the CPU 110 also sets the charging bias and the primary transfer bias to respective predetermined values according to the absolute humidity calculated from the temperature and the humidity detected by the temperature and humidity sensor 190.

Figure 14:
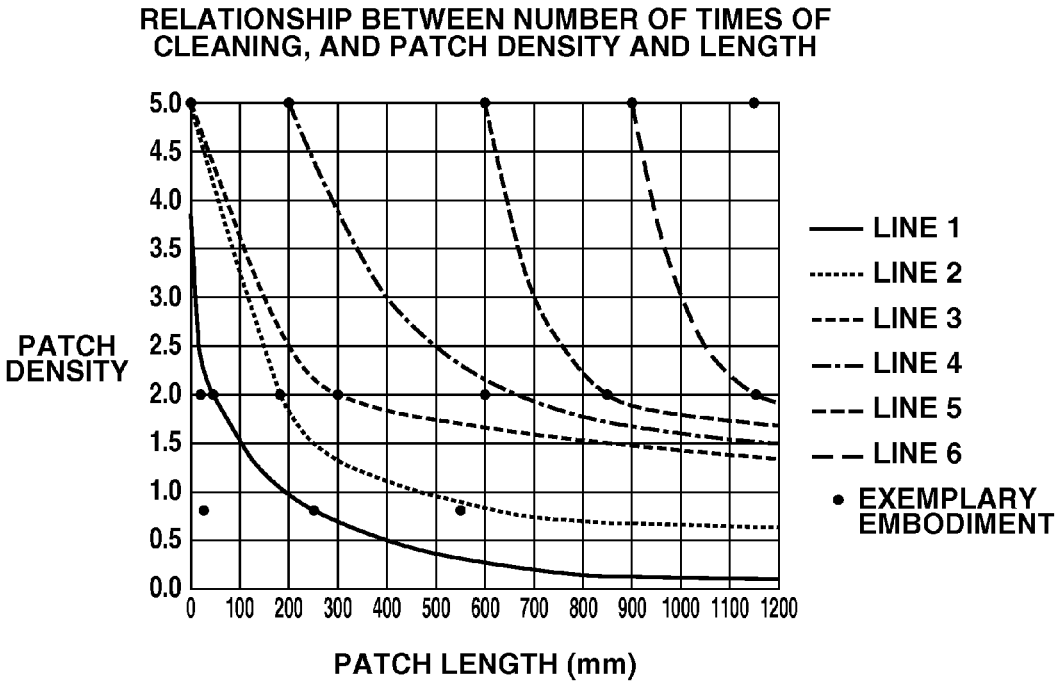
FIG. 14 is a graph indicating a relationship between the number of times of the cleaning, and the density and the length of the patch.

FIG. 14 is a graph indicating a result of the comparison among the cleaning performances that was carried out by varying the density and length with use of the above-described patches illustrated in FIG. 7 (a same density is used for the densities of the patches of the respective colors in the patch group formed for a single sample).

In FIG. 14, the toner lengths are plotted on a horizontal axis, and the toner densities are plotted on a vertical axis. The threshold values are plotted according to the number of times of the cleaning set as a condition in the following manner. Line 1 represents a threshold value when the cleaning is completed by the electrostatic cleaning during the first rotation (i.e., the number of times of the cleaning is 1). Further, Line 2 represents a threshold value when the cleaning is completed by the opposite bias cleaning during the first rotation (i.e., the number of times of the cleaning is 2). Further, Line 3 represents a threshold value when the cleaning is completed by the electrostatic cleaning during the second rotation (i.e., the number of times of the cleaning is 3). Further, Line 4 represents a threshold value when the cleaning is completed by the opposite bias cleaning during the second rotation (i.e., the number of times of the cleaning is 4). Further, Line 5 represents a threshold value when the cleaning is completed by the electrostatic cleaning during the third rotation (i.e., the number of times of the cleaning is 5). Each of the threshold value Lines means that the cleaning can be completed under each of the above-described conditions regarding these threshold value Lines, if the density and the length correspond to or fall below each of the threshold value Lines. A table 2 indicates the number of times of the cleaning and a conveyance distance of the intermediate transfer belt 7 (the number of rotations based on the leading edge of the patch) until the cleaning is completed in correspondence with each the above-described threshold value Lines. In this table, the number of times of the opposite bias cleaning is incremented by one when the patch passes once through the primary transfer portions T1Y to T1K of the first to fourth image forming units SY to SK (i.e., the patch passes through the primary transfer portion T1 with the opposite bias applied thereto four times). Further, a table 3 indicates lengths and densities corresponding to main patch conditions and actual patch types, which are indicated as plotted points in FIG. 14. The patch density can be expressed by a toner amount per unit area (also referred to as an "application amount"). The relationship between the patch density and the application amount varies depending on a component in the toner such as a pigment. In the present exemplary embodiment, the density of 0.8, a density of 2.0, and a density of 5.0 correspond to an application amount of 0.2 g/cm$^2$, an application amount of 0.5 g/cm$^2$, and an application amount of 1.25 g/cm$^2$, respectively.

TABLE 2

| LINE | NUMBER OF TIMES OF ELECTROSTATIC CLEANING | NUMBER OF TIMES OF OPPOSITE BIAS CLEANING (FOUR COLORS COUNTED AS ONE TIME) | CONVEYANCE DISTANCE OF INTERMEDIATE TRANSFER BELT (NUMBER OF ROTATIONS) |
|---|---|---|---|
| 1 | ONCE | ZERO TIMES | ONE ROTATION |
| 2 | ONCE | ONCE | ONE AND HALF ROTATIONS |
| 3 | TWICE | ONCE | TWO ROTATIONS |
| 4 | TWICE | TWICE | TWO AND HALF ROTATIONS |
| 5 | THREE TIMES | TWICE | THREE ROTATIONS |
| 6 | THREE TIMES | THREE TIMES | THREE AND HALF ROTATIONS |
| 7 | FOUR TIMES | THREE TIMES | FOUR ROTATIONS |

TABLE 3

| | LENGTH | DENSITY |
|---|---|---|
| NO. 1 | 25 | 0.8 |
| NO. 2 | 250 | 0.8 |
| NO. 3 | 550 | 0.8 |
| NO. 4 | 25 | 2.0 |
| NO. 5 | 50 | 2.0 |
| NO. 6 | 180 | 2.0 |
| NO. 7 | 300 | 2.0 |
| NO. 8 | 600 | 2.0 |
| NO. 9 | 850 | 2.0 |
| NO. 10 | 1150 | 2.0 |
| NO. 11 | 5 | 5.0 |
| NO. 12 | 200 | 5.0 |
| NO. 13 | 600 | 5.0 |
| NO. 14 | 900 | 5.0 |
| NO. 15 | 1150 | 5.0 |

First, the density of 0.8 and the length of 25 mm, for which the cleaning was able to be completed by Line 1, i.e., carrying out the electrostatic cleaning once, are equivalent to the above-described ATR patch. As such, the result reveals that the cleaning for the ATR patch can be completed by one rotation as the number of rotations of the intermediate transfer belt 7. Further, the patch transferred onto the intermediate transfer belt 7 in the black monochrome mode has a smaller toner amount than the ATR patch. The density of the patch transferred onto the intermediate transfer belt 7 in this case is 0.8 at most, and the length thereof is, for example, 250 mm in the case of 10 patches. In this case, the cleaning is also completed by one rotation as the number of rotations of the intermediate transfer belt 7. Further, for a length of 100 mm, a density of 1.5 is a maximum density for which the cleaning can be completed by carrying out the electrostatic cleaning once. It is considered that this is because the patch length of 100 mm corresponds to a length of one rotation of the fur brush 91, and the density of 1.5 is a maximum density that can be collected by one rotation of the fur brush 91. The toner collected by the fur brush 91 is electrostatically attracted onto the bias roller 92 by contacting the bias roller 92. However, there is a limit on the collectable toner amount, and the fur brush 91 carries out the cleaning during a second rotation with the toner remaining uncollected thereon, whereby it is considered that some toner slips through when a larger toner amount than the density of 1.5 is delivered to the fur brush 91.

An increase in the diameter of the fur brush 91 to elongate the cleanable length, or an increase in the density of the fur brush 91 enables the fur brush 91 to collect a larger toner amount. However, the increase in the diameter of the fur brush 91 leads to an increase in the size of the cleaning portion. Further, the increase in the density of the fur brush 91 leads to an increase in frictional sliding with the intermediate transfer belt 7. As a result, in some cases, the bristles of the fur brush may be tilted to impair the collection performance. Alternatively, the temperature of the cleaning portion may increase, so that the temperature in the apparatus may increase. Alternatively, the intermediate transfer belt 7 itself may be damaged to shorten the operating life thereof.

Next, carrying out the electrostatic cleaning once (Line 2) and carrying out the opposite bias cleaning once (conveying the patch through the primary transfer portion T1 with the opposite bias applied thereto four times) was able to complete the cleaning for the patch at the density of 0.8 that was 550 mm or shorter in length. The result reveals that a longer length than that, for example, a longer length than 600 mm requires execution of the electrostatic cleaning one more time. The toner unable to be collected by carrying out the electrostatic cleaning once is attached to the intermediate transfer belt 7 with a stronger mechanical attachment force, because this toner has been rubbed against the intermediate transfer belt 7 twice by the upstream fur brush 91*a* and the downstream fur brush 91*b*. Further, the application of the bias also increases triboelectricity (an electrification charge amount) of the toner, and thus the remaining toner is also attached to the intermediate transfer belt 7 with a stronger electric attraction force. Therefore, applying the opposite bias while exerting a pressure at the primary transfer portion T1 facilitates the collection of the toner attached to the intermediate transfer belt 7.

Next, when the density was the density of 2.0, which was a maximum monochrome density, the cleaning was able to be completed by carrying out the electrostatic cleaning once for the length of 25 mm corresponding to a single patch, but the result reveals that a longer length than that requires an increase in the number of times of the cleaning. A length of 180 mm or shorter required execution of the electrostatic cleaning once and execution of the opposite bias cleaning once (conveying the patch through the primary transfer portion T1 with the opposite bias applied thereto four times). Then, the length was further increased. For a length of 300 mm or shorter, the cleaning was able to be completed by carrying out the electrostatic cleaning twice and carrying out the opposite bias cleaning once. Further, for a length of 600 mm or shorter, the cleaning was able to be completed by carrying out the electrostatic cleaning twice and carrying out the opposite bias cleaning twice. Further, for a length of 850 mm or shorter, the cleaning was able to be completed by carrying out the electrostatic cleaning three times and carrying out the opposite bias cleaning twice. In this manner, the result reveals that, as the length increases, the cleaning should be carried out a larger number of times. A length of 1150 mm corresponding to one rotation of the intermediate transfer belt 7 required execution of the electrostatic cleaning three times and execution of the opposite bias cleaning three times to complete the cleaning.

In light of the above-described result, in the present exemplary embodiment, the image forming apparatus 100 is set so as to complete the cleaning for the patch by carrying out the electrostatic cleaning once, and carrying out the opposite bias cleaning once and the electrostatic cleaning one more time after that (two rotations of the intermediate transfer belt 7) at the time of the image density adjustment in the full color mode. Further, the image forming apparatus 100 is set so as to complete the cleaning for the patch by carrying out the electrostatic cleaning only once (one rotation of the intermediate transfer belt 7) at the time of the image density adjustment in the black monochrome mode. Further, the image forming apparatus 100 is also set so as to complete the cleaning for the patch by carrying out the electrostatic cleaning only once (one rotation of the intermediate transfer belt 7) at the time of the ATR control.

The result reveals that, for the density of 5.0 and the application amount of 1.25 g/cm$^2$, which is a maximum application amount in the configuration according to the present exemplary embodiment, a length of 200 mm requires execution of the electrostatic cleaning twice and execution of the opposite bias cleaning twice. Further, the result reveals that the length of 600 mm requires execution of the electrostatic cleaning three times and execution of the opposite bias cleaning twice. Further, the result reveals that a length of 900 mm requires execution of the electrostatic cleaning three times and execution of the opposite bias cleaning three times. On the other hand, it is desirable to set the cleaning of the intermediate transfer belt 7 after a jam (a paper jam), assuming that this cleaning corresponds to the cleaning for the patch formed at the density of 5.0, which is the maximum application amount, by a length of 820 mm corresponding to a length from the primary transfer portion T1 (the most upstream primary transfer portion T1Y) to the secondary transfer portion T2. Therefore, after a jam occurs, the image forming apparatus 100 has to carry out the electrostatic cleaning three times and carry out the opposite bias cleaning three times (three and a half rotations of the intermediate transfer belt 7).

In this manner, in the present exemplary embodiment, the image forming apparatus 100 includes the cleaning portions CL2 and T1Y to T1K that electrostatically remove the toner attached to the intermediate transfer member 7. Further, this image forming apparatus 100 includes the control unit 110 that controls the cleaning operation of rotating the intermediate transfer member 7 to remove the adjustment toner image formed on the image bearing member 1 and attached to the intermediate transfer member 7 during the adjustment operation at the cleaning portion. Then, the control unit 110 changes the number of times of conveying the adjustment toner image on the intermediate transfer member 7 to the cleaning portion according to at least one of the density and the length in the conveyance direction of the intermediate transfer member 7 regarding the adjustment toner image on the intermediate transfer member 7 before the adjustment toner image is conveyed to the cleaning portion. Typically, the control unit 110 increases the above-described number of times, as the density of the adjustment toner image increases, or the length of the adjustment toner image in the conveyance direction of the intermediate transfer member 7 increases. Further, in the present exemplary embodiment, the plurality of image bearing members 1 is disposed along the rotational direction of the intermediate transfer member 7. The plurality of image bearing members 1 includes the first image bearing members 1Y to 1C, each of which bears the adjustment toner image that is actively transferred onto the intermediate transfer member 7 to be detected on the intermediate transfer member 7 after being formed. Further, the plurality of image bearing members 1 includes the second image bearing member 1K, which bears the adjustment toner image that is detected on the image bearing member 1K and is not actively transferred onto the intermediate transfer member 7 after being formed. Then, the control unit 110 changes the above-described number of times according to which case the present case is between the following two cases. A first case is a case of removing the adjustment toner image formed on at least the first image bearing members 1Y to 1C and then transferred and attached onto the intermediate transfer member 7. Another case is a case of removing the adjustment toner image formed on only the second image bearing member 1K and then attached to the intermediate transfer member 7 by contacting the intermediate transfer member 7 during the adjustment operation. Typically, the control unit 110 sets the above-described number of times to a larger number for the removal of the adjustment toner image transferred from at least the first image bearing members 1Y to 1C.

In this manner, according to the present exemplary embodiment, the image forming apparatus 100 adjusts the number of times of the cleaning according to at least one of the patch density and the patch length, thereby succeeding in minimizing a time taken to carry out the cleaning for the patch to achieve the excellent cleaning for the patch without reducing the productivity.

Other Embodiments

The present invention has been described based on the specific exemplary embodiment, but the present invention is not limited to the above-described exemplary embodiment.

For example, the above exemplary embodiment has been described assuming that the patch, which is the adjustment toner image, is formed on the sheet-to-sheet space, but the present invention is not limited thereto. The patch can be formed at an arbitrary timing during a non-image formation period other than an image formation period during which the image forming apparatus 100 forms an output image to be output by being transferred onto the transfer medium P. The image formation period here means a period during which the image forming apparatus 100 forms the electrostatic latent image of the output image, develops the electrostatic latent image, carries out the primary transfer, and carries out the secondary transfer, and the non-image formation period means a period other than that. Examples of the non-image formation period include the following periods. A first example is a period of a pre-multi-rotation operation, which is a preparation operation performed, for example, when the image forming apparatus 100 is powered on. Further, another example is a period of a pre-rotation operation, which is a preparation operation performed from an input of an instruction to start the image formation until an actual start of the image formation. Another example is a time interval between sheets, which corresponds to a period between a transfer medium and a transfer medium when images are formed on a plurality of transfer media. Another example is a period of a post-rotation operation, which is an arrangement operation (a preparation operation) performed after the image formation is ended. For example, also employing the present invention when the patch is formed during the post-rotation operation can improve the productivity as a whole, for example, when a plurality of jobs (a series of image forming operations onto one or more transfer media according to a single instruction to start the image formation) is waiting.

Further, in the above-described exemplary embodiment, the image forming apparatus 100 adjusts the number of times of the cleaning as a whole with use of the electrostatic cleaning and the opposite bias cleaning. However, the image forming apparatus 100 may be configured to collect the toner of the patch by carrying out only the electrostatic cleaning, and adjust only the electrostatic cleaning. In this case, when the toner of the patch passes through the primary transfer portion T1, this configuration can handle this situation by allowing the toner to pass through the primary transfer portion T1, for example, by applying a bias having the same polarity as the polarity at the time of the normal image formation to the primary transfer portion T1, or separating the intermediate transfer belt 7 from the photosensitive drum 1.

Further, in the above-described exemplary embodiment, the image forming apparatus 100 changes the opposite electric field from the electric field at the time of the transfer that is generated at each of the cleaning portions CL1, CL2, and T1Y to T1K according to the absolute humidity acquired from the temperature and the humidity under the environment of the image forming apparatus 100. However, the present invention is not limited thereto. In a case where it is known that an optimum electric field varies depending on at least one of the temperature and the humidity, the image forming apparatus 100 may change the electric field according to at least one of the temperature and the humidity under the environment of the image forming apparatus 100.

Further, the primary transfer member and the secondary transfer member are not limited to the roller-shaped members. For example, the primary transfer member and the secondary transfer member each may be an arbitrarily configured member, such as a plate-shaped member (a blade-shaped member), a sheet-shaped member, a brush-shaped member, and a block-shaped member disposed so as to contact the moving intermediate transfer member 7 and frictionally slide thereon. Further, the collection member included in the cleaning member 96 is not limited to the fur roller. For example, the collection member may be a sponge roller, a rubber roller, a fixed brush, or the like.

Further, the above exemplary embodiment has been described assuming that the intermediate transfer member is the intermediate transfer belt made of the endless belt. However, the intermediate transfer member is not limited thereto. For example, the intermediate transfer member may be an intermediate transfer drum shaped as a drum by stretching a sheet made of a similar material to the intermediate transfer belt 7 according to the above-described exemplary embodiment across a frame body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107610, filed May 23, 2014, which is hereby incorporated by reference herein in its entirety.

What is claimed is:

1. An image forming apparatus comprising:

an image bearing member configured to bear a toner image;

a movable intermediate transfer member configured to temporarily bear the toner image that is transferred from the image bearing member at a first transfer portion and then transferred onto a recording medium at a second transfer portion;

a cleaning member disposed opposing the intermediate transfer member on a downstream side of the second transfer portion and on an upstream side of the first transfer portion in a movement direction of the intermediate transfer member, and configured to electrostatically remove toner on the intermediate transfer member at a cleaning portion;

a forming portion configured to form, on the intermediate transfer member, an adjustment toner image having a predetermined target density and a predetermined length in the movement direction of the intermediate transfer member;

a detection portion configured to detect the adjustment toner image formed on the intermediate transfer member;

a change portion configured to change an image forming condition according to a detection result of the detection portion; and an execution portion configured to move the intermediate transfer member to cause a region on the intermediate transfer member that corresponds to a position at which the adjustment toner image is formed to pass through the cleaning portion, wherein the execution portion sets the number of times of repeatedly causing the region to pass through the cleaning portion based on at least one of the target density and the length of the adjustment toner image.

2. The image forming apparatus according to claim 1, wherein, the execution portion sets the number of times when the predetermined length of a first adjustment toner image having a first length to a larger number than the number of times when the predetermined length of a second adjustment toner image having a second length, which is shorter than the first length, on condition that the target density of the first adjustment toner image is substantially the same as the second adjustment toner image.

3. The image forming apparatus according to claim 1, wherein, the execution portion sets the number of times when the target density of a first adjustment toner image having a first density to a larger number than the number of times when the target density of a second adjustment toner image having a second target density, which is lower than the first target density, on condition that the predetermined length of the first adjustment toner image is substantially the same as the second adjustment toner image.

4. An image forming apparatus comprising:

a first image bearing member and a second image bearing member configured to bear toner images thereon, respectively;

the intermediate transfer member configured to be movable and temporarily bear the toner images that are transferred from the first and second image bearing members at respective first transfer portions and then transferred onto a recording medium at a second transfer portion, the first image bearing member and the second image bearing member being arranged side by side in a movement direction of the intermediate transfer member;

a forming portion configured to form a first adjustment toner image and a second adjustment toner image, the first adjustment toner image being detected on the intermediate transfer member after being formed on the first image bearing member and then transferred onto the intermediate transfer member by applying a transfer electric field at the first transfer portion of the first image bearing member, the second adjustment toner image being formed on the second image bearing member and then detected on the second image bearing member, the second adjustment toner image being partially attached to the intermediate transfer member without the transfer electric field applied at the first transfer portion of the second image bearing member;

a cleaning member disposed opposing the intermediate transfer member on a downstream side of the second transfer portion and on an upstream side of the first transfer portion in the movement direction of the intermediate transfer member, and configured to electrostatically remove toner on the intermediate transfer member at a cleaning portion;

a first detection portion configured to detect the first adjustment toner image on the intermediate transfer member;

a second detection portion configured to detect the second adjustment toner image on the second image bearing member;

a change portion configured to change an image forming condition according to a detection result of at least one of the first detection portion and the second detection portion; and an execution portion configured to move the intermediate transfer member to cause regions on the intermediate transfer member that correspond to positions at which the first and second adjustment toner images are formed to pass through the cleaning portion, wherein the execution portion sets the number of times of repeatedly causing each of the regions to pass through the cleaning portion to a different number between a removal of the first adjustment toner image and a removal of the second adjustment toner image.

5. The image forming apparatus according to claim 4, wherein the execution portion sets the number of times for removing the first adjustment toner image to a larger number than the number of times for removing the second adjustment toner image.

6. The image forming apparatus according to claim 4, wherein, if the execution portion repeatedly causes the region to pass through the cleaning portion, the execution portion applies an opposite electric field from the transfer electric field to the first transfer portion when the region passes through the first transfer portion.

7. The image forming apparatus according to claim 4, wherein an electric field for moving toner, having a same polarity as toner of a toner image formed on the image bearing member, from the intermediate transfer member to the cleaning member is generated at the cleaning portion.

8. The image forming apparatus according to claim 7, wherein the electric field is changed according to the number of times that the adjustment toner image on the intermediate transfer member is repeatedly conveyed to the cleaning portion.

9. The image forming apparatus according to claim 7, wherein the electric field is changed according to at least one of a temperature and a humidity of an environment of the image forming apparatus.

10. The image forming apparatus according to claim 4, wherein a second transfer member is disposed at the second transfer portion, the second transfer member being brought into contact with the intermediate transfer member via a transfer medium to transfer a toner image from the intermediate transfer member to the transfer medium, and wherein the second transfer member is separated from the intermediate transfer member when the adjustment toner image on the intermediate transfer member passes through the second transfer portion.

* * * * *